US012181264B2

(12) United States Patent
Carr et al.

(10) Patent No.: US 12,181,264 B2
(45) Date of Patent: Dec. 31, 2024

(54) PROGRAMMABLE SYSTEM AND METHOD FOR A MUNITION

(71) Applicant: BAE SYSTEMS plc, London (GB)

(72) Inventors: Andrew Carr, Portsmouth (GB); Murray Thomson, Portsmouth (GB); Timothy Keith Girling, Portsmouth (GB); Martyn John Hucker, Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 17/413,149

(22) PCT Filed: Dec. 17, 2019

(86) PCT No.: PCT/GB2019/053586
§ 371 (c)(1),
(2) Date: Jun. 11, 2021

(87) PCT Pub. No.: WO2020/128454
PCT Pub. Date: Jun. 25, 2020

(65) Prior Publication Data

US 2022/0049943 A1 Feb. 17, 2022

(30) Foreign Application Priority Data

Dec. 19, 2018 (EP) ..... 18275186
Dec. 19, 2018 (GB) ..... 1820705
(Continued)

(51) Int. Cl.
*F42B 15/22* (2006.01)
*F42B 12/20* (2006.01)
(Continued)

(52) U.S. Cl.
CPC ..... *F42C 11/005* (2013.01); *F42B 12/204* (2013.01); *F42B 12/62* (2013.01);
(Continued)

(58) Field of Classification Search
CPC ..... F42C 11/005; F42C 13/06
See application file for complete search history.

(56) References Cited

U.S. PATENT DOCUMENTS 1,339,188 A 5/1920 Frecska
2,060,198 A * 11/1936 Hammond, Jr. ..... F42C 13/06 114/21.3
(Continued)

FOREIGN PATENT DOCUMENTS

CA 3124293 A1 6/2020
DE 321456 C 5/1920
(Continued)

OTHER PUBLICATIONS

International Search Report and Written Opinion received for PCT Application No. PCT/GB2019/053586. Mail date: Apr. 6, 2020. 11 pages.
(Continued)

*Primary Examiner* — Derrick R Morgan
(74) *Attorney, Agent, or Firm* — Finch & Maloney PLLC

(57) ABSTRACT

According to a first aspect of the invention, there is provided a programmable system for a munition, comprising: an electroacoustic transducer, arranged to receive an acoustic signal comprising data, and convert that signal into an electrical signal comprising data; a processor, arranged to receive and process the electrical signal comprising data, and to use that data in programming of the programmable system.

20 Claims, 17 Drawing Sheets

(30) Foreign Application Priority Data

| | | |
|---|---|---|
| Sep. 4, 2019 | (GB) | 1912696 |
| Dec. 5, 2019 | (EP) | 19275140 |
| Dec. 5, 2019 | (EP) | 19275141 |
| Dec. 5, 2019 | (GB) | 1917753 |
| Dec. 5, 2019 | (GB) | 1917754 |

(51) Int. Cl.

| | |
|---|---|
| ***F42B 12/62*** | (2006.01) |
| ***F42B 21/00*** | (2006.01) |
| ***F42B 30/08*** | (2006.01) |
| ***F42C 5/00*** | (2006.01) |
| ***F42C 11/00*** | (2006.01) |
| ***F42C 13/06*** | (2006.01) |
| ***F42C 15/32*** | (2006.01) |
| ***F42C 15/40*** | (2006.01) |
| *F42B 12/36* | (2006.01) |
| *F42C 9/00* | (2006.01) |
| *F42C 13/08* | (2006.01) |

(52) U.S. Cl.

CPC ..... *F42B 21/00* (2013.01); *F42B 30/08* (2013.01); *F42C 5/00* (2013.01); *F42C 13/06* (2013.01); *F42C 15/32* (2013.01); *F42C 15/40* (2013.01); *F42B 12/365* (2013.01); *F42C 9/00* (2013.01); *F42C 13/08* (2013.01)

(56) References Cited

U.S. PATENT DOCUMENTS 2,391,966 A 1/1946 Harrison
2,480,927 A 9/1949 Hopkins
2,489,255 A * 11/1949 Barker ..... F42C 13/06 367/133
2,803,135 A 8/1957 New
2,884,859 A 5/1959 Alexander et al.
2,955,558 A 10/1960 Johnson et al.
2,960,009 A 11/1960 Hereth et al.
2,969,033 A 1/1961 Vacquier
2,995,102 A 8/1961 Jones
3,005,434 A * 10/1961 Bennett ..... F42B 19/01 114/23
3,011,738 A 12/1961 Skramstad et al.
3,017,832 A * 1/1962 MacDonald ..... F42C 13/06 102/391
3,115,833 A * 12/1963 Hall ..... F42C 13/06 102/391
3,252,417 A * 5/1966 Johnson, Jr. ..... F42C 15/32 102/420
3,343,492 A * 9/1967 Kritz ..... H02J 7/32 102/221
3,648,636 A * 3/1972 Mentcher ..... F41G 7/228 114/23
3,651,697 A 3/1972 Ianuzzi
3,653,324 A 4/1972 Furlani et al.
3,677,184 A * 7/1972 Rabinow ..... F42C 15/32 102/211
3,723,954 A * 3/1973 Nelkin ..... G01S 15/52 367/901
3,728,982 A * 4/1973 Dunlap ..... F42B 12/207 114/21.1
3,738,270 A * 6/1973 Hargett ..... F41G 7/228 102/472
3,802,365 A 4/1974 Reeser
3,853,081 A * 12/1974 Daudelin ..... F41G 7/36 60/253
3,938,438 A 2/1976 Anderson et al.
3,962,902 A 6/1976 Aquilina et al.
4,064,806 A * 12/1977 Apstein ..... H04B 11/00 367/133
4,129,086 A * 12/1978 Schwarz ..... F41G 7/228 114/23
4,189,999 A * 2/1980 Anderson ..... F42C 13/06 367/133
4,207,819 A * 6/1980 Geren ..... F42B 22/42 367/1
4,215,630 A * 8/1980 Hagelberg ..... B63G 9/02 89/36.17
4,274,353 A * 6/1981 Foss ..... G10K 11/008 114/21.3
4,341,173 A * 7/1982 Hagelberg ..... B63H 11/12 60/221
4,372,239 A * 2/1983 Hagelberg ..... F42B 17/00 367/133
4,603,635 A 8/1986 Boudreau
4,703,693 A 11/1987 Spies et al.
4,727,810 A * 3/1988 Furst ..... F42C 19/06 102/263
4,833,991 A 5/1989 Furst
4,977,545 A * 12/1990 Teel ..... F42C 13/06 367/126
5,012,717 A * 5/1991 Metersky ..... F41G 7/2206 114/21.3
5,078,069 A * 1/1992 August ..... F42B 12/16 114/20.1
5,111,748 A 5/1992 Thurner et al.
5,210,372 A 5/1993 Tripptrap et al.
5,214,618 A * 5/1993 Bugiel ..... F42B 19/00 367/136
5,245,927 A 9/1993 Ranes
5,271,327 A 12/1993 Filo et al.
5,275,107 A 1/1994 Weber et al.
5,456,427 A * 10/1995 Greenhalgh ..... F42B 10/62 89/1.51
5,577,431 A * 11/1996 Kusters ..... F42B 12/58 89/1.51
5,677,506 A 10/1997 Wallin
5,761,154 A * 6/1998 Mueller ..... F42C 13/06 367/96
5,831,206 A * 11/1998 Cooper ..... F42B 21/00 114/21.1
5,929,370 A * 7/1999 Brown ..... F42B 15/22 102/501
5,955,698 A 9/1999 Harkins et al.
6,108,270 A 8/2000 DePoy, II
6,220,168 B1 * 4/2001 Woodall ..... B63B 22/003 102/411
6,405,653 B1 6/2002 Miskelly
6,411,565 B1 6/2002 Sirmalis et al.
6,453,790 B1 9/2002 Cesulka et al.
6,494,140 B1 12/2002 Webster
6,629,498 B1 10/2003 Marquis
6,679,159 B1 1/2004 Hullett
8,468,944 B2 6/2013 Givens et al.
8,740,071 B1 6/2014 Higgs et al.
8,985,025 B1 3/2015 Manz et al.
9,846,011 B1 12/2017 Clark et al.
9,857,156 B1 1/2018 McKeon et al.
10,065,718 B1 9/2018 Husain et al.
10,514,240 B1 * 12/2019 Despain ..... F42B 12/58
10,520,298 B2 12/2019 Chen et al.
11,051,114 B2 6/2021 Kent
2003/0005872 A1 1/2003 DePoy, II
2003/0070571 A1 * 4/2003 Hodge ..... F42C 15/34 102/221
2003/0159609 A1 8/2003 Rauscher, Jr.
2004/0163564 A1 8/2004 Sutcliffe
2009/0078146 A1 * 3/2009 Tepera ..... F42B 12/60 102/501
2009/0256024 A1 * 10/2009 Rastegar ..... F42C 11/008 244/3.11
2012/0012022 A1 1/2012 Bormann et al.
2013/0180423 A1 7/2013 Rastegar et al.
2014/0216290 A1 * 8/2014 Yee ..... F41F 3/04 102/374
2014/0338555 A1 * 11/2014 Thomas ..... F42B 21/00 86/18
2015/0128823 A1 * 5/2015 Akcasu ..... F42B 10/56 102/501

(56) References Cited

U.S. PATENT DOCUMENTS

| | | | | |
|---|---|---|---|---|
| 2017/0184525 | A1 | 6/2017 | Hucker et al. | |
| 2019/0310356 | A1* | 10/2019 | Moore | G01S 7/52004 |
| 2020/0033106 | A1 | 1/2020 | Turner et al. | |
| 2021/0071621 | A1 | 3/2021 | Lefcourt et al. | |
| 2022/0065604 | A1 | 3/2022 | Carr et al. | |
| 2022/0090893 | A1* | 3/2022 | Carr | F42B 12/62 |
| 2022/0120546 | A1 | 4/2022 | Carr et al. | |

FOREIGN PATENT DOCUMENTS

| | | | | | |
|---|---|---|---|---|---|
| DE | 3442456 | A1 | | 9/1986 | |
| DE | 3610358 | A1 | | 10/1987 | |
| DE | 3800407 | C1 | | 3/1989 | |
| DE | 3937762 | A1 | | 5/1991 | |
| DE | 19831807 | A1 | | 2/1999 | |
| DE | 102007048072 | A1 | | 4/2009 | |
| EP | 0149778 | A2 | | 7/1985 | |
| EP | 0281088 | A2 | | 3/1988 | |
| FR | 2640371 | A1 | | 6/1990 | |
| GB | 2188402 | A | | 9/1987 | |
| GB | 2277980 | A | | 11/1994 | |
| KR | 20120027668 | | * | 3/2012 | F42B 19/38 |
| WO | 2009046799 | A1 | | 4/2009 | |
| WO | 2014037934 | A1 | | 3/2014 | |
| WO | 2020128437 | A2 | | 6/2020 | |
| WO | 2020128437 | A3 | | 6/2020 | |
| WO | 2020128451 | A1 | | 6/2020 | |
| WO | 2020128453 | A1 | | 6/2020 | |
| WO | 2020128454 | A1 | | 6/2020 | |

OTHER PUBLICATIONS

Examination Report under Section 18(3) received for GB Application No. 1918630.3, dated Jun. 10, 2020. 6 pages.

International Search Report and Written Opinion received for PCT Application No. PCT/GB2019/053533. Mail date: Jun. 24, 2020. 17 pages.

Invitation to Pay Additional Fees and Partial International Search Report received for PCT Application No. PCT/GB2019/053533. Mail date: Mar. 17, 2020. 11 pages.

Partial European Search Report received for EP Application No. 18275186.7, dated Jun. 24, 2019. 14 pages.

Extended European Search Report received for EP Application No. 18275186.7, dated Sep. 26, 2019. 12 pages.

GB Search Report under Section 17(5) received for GB Application No. 1820705.0, dated Mar. 1, 2019. 4 pages.

International Preliminary Report on Patentability received for PCT Application No. PCT/GB2019/053533. Mail date: Jul. 1, 2021. 11 pages.

International Preliminary Report on Patentability received for PCT Application No. PCT/GB2019/053579. Mail date: Jul. 1, 2021. 7 pages.

International Preliminary Report on Patentability received for PCT Application No. PCT/GB2019/053586. Mail date: Jul. 1, 2021. 7 pages.

International Preliminary Report on Patentability received for PCT Application No. PCT/GB2019/053583. Mail date: Jul. 1, 2021. 7 pages.

International Search Report and Written Opinion received for PCT Application No. PCT/GB2019/053579. Mail date: Apr. 2, 2020. 10 pages.

Combined Search and Examination Report under Sections 17 and 18(3) received for GB Application No. 1918622.0, dated May 22, 2020. 4 pages.

International Search Report and Written Opinion received for PCT Application No. PCT/GB2019/053583. Mail date: Apr. 7, 2020. 11 pages.

Combined Search and Examination Report under Sections 17 and 18(3) received for GB Application No. 1918625.3, dated Jun. 4, 2020. 5 pages.

* cited by examiner

PROGRAMMABLE SYSTEM AND METHOD FOR A MUNITION

The present invention relates generally to a munition or munition assembly, and in particular to a munition or munition assembly that is adapted to be launched, into the air, from a gun barrel. A related submunition, assembly, method, and reconnaissance projectile assembly and reconnaissance sub-projectile are also provided. Apparatus and methods suitable for use with such munitions and submunitions, and suitable for more general use, are also provided.

For the purposes of this disclosure, aspects, embodiments, and general description and discussion of munitions, in terms of technical details or associated functionality, applies equally to submunitions. In some instances, for certain functionality, the term munition will be understood to cover the term submunition. For example, this is in instances where it is not important if the functionality is linked to the "sub" nature of the submunition, but is instead linked to the explosive nature of the munition in general. In other words, it may not be necessary for the munition to be expelled from a carrier, in order to embody the inventive concept that is being described. This is clear from the disclosure as a whole.

Munitions are provided in a number of different forms, for a number of different applications. Typically, a particular munition will be used for a particular application or intention. A good example of this is when an application involves engaging with or generally interacting with an underwater object (e.g. a target).

When engaging an underwater target, a typical approach is to use a depth charge. The depth charge is dropped off the side of a vessel, or from a helicopter or similar, and the depth charge then descends in the water to a predetermined depth where the depth charge is activated (i.e. detonates). Ideally, this depth will be in the general vicinity of the object or target to be engaged, to damage or disable that target. While engaging a target with one or more depth charges has been relatively commonplace for decades, and is often effective, there are disadvantages. One of the main disadvantages is range. That is, while the depth charge may inflict the required damage on the underwater target, this may be difficult or impossible to achieve if the underwater target is not located immediately below the vessel engaged in that target, but is instead located some distance away from the vessel (e.g. measured across the surface of the water), for example hundreds of metres, or kilometres. Additionally, it may be difficult to engage the target with multiple depth charges simultaneously, or simultaneously from multiple vessels. Also, any explosion caused by the depth charge may, if in the vicinity of the vessel itself, risk damaging the actual vessel that deployed the depth charge.

While the use of helicopters can of course significantly increase the range of the use of depth charge from the vessel deploying the depth charge or helicopter, this then necessarily involves the use of a helicopter, which can be expensive or risky. Of course, it is not practical, and sometimes not possible, to use one or more, or a swarm, of helicopters in order to deploy multiple, or a swarm, of depth charges at any significant distance from the vessel. Also, even though helicopters are fast moving, it may take a significant amount of time for a helicopter to reach a target location, and deploy the depth charge. This is particularly the case when the helicopter is not already in flight, when a command or instruction to engage is issued.

Another approach involves the use of mortar bombs. Mortar bombs may be launched from the deck of a vessel, and into the surrounding water, where the mortar bombs then descend to a particular depth and explode to disable or damage the underwater target. While these mortar bombs perhaps have an increased range in comparison with the use of depth charges, their explosive capability is perhaps not as significant as a depth charge. Also, the firing accuracy is not ideal, and the range of the mortar bomb, is still limited.

A yet further approach to engaging underwater targets is the use of torpedoes, for example deck-launched torpedoes launched from the deck of a vessel, or those launched from a submarine, helicopter or airplane. The use of torpedoes might overcome some of the problems discussed above with regard to range, mainly because torpedoes are self-propelled. However, torpedoes are ultimately too expensive to be used speculatively, or too expensive to use multiple torpedoes at any one time to cause multiple explosions in or around the vicinity of an expected or determined location of the target.

Additionally, even when a munition is fired from a gun, achieving significant range with great accuracy, a natural (e.g. ballistic) trajectory will result in impact with a surface of a body of water that is likely to cause damage to the munition, a significant change of course of the munition, or generally result in the munition not functioning as perhaps initially intended.

It is also sometimes important to be able to in some way communicate with a munition, for example sending data to the munition for programming of systems of that munition. This might be undertaken using electromagnetic radiation. However, this might not be practical or cost effective, and in some situations might not even be a viable option, for example when the munition is to be used under water. Another approach is to use, for example, inductive coupling or similar, this has a very short range of operation and might require additional components to introduce or ensure galvanic isolation of components of the munition for safety purposes. A further approach might involve the use of electrical contacts between the munition and a communicating or setting device. Again, this requires the components of the munition and communicator to be in close proximity with one another, and requires careful implementation to introduce the galvanic isolation described above. Improvements are therefore required.

It is an example aim of example embodiments of the present invention to at least partially avoid or overcome one or more disadvantages of the prior art, whether identified herein or elsewhere, or to at least provide a viable alternative to existing apparatus and methods.

According to a first aspect of the invention, there is provided a programmable system for a munition, comprising: an electroacoustic transducer, arranged to receive an acoustic signal comprising data, and convert that signal into an electrical signal comprising data; a processor, arranged to receive and process the electrical signal comprising data, and to use that data in programming of the programmable system.

The system may be a programmable fuze system.

The programmable system may be arranged to facilitate programming of arming or targeting functions.

The system may comprise one or more electroacoustic transducers, for communicating across one or more physical barriers in the munition.

The one or more physical barriers may comprise a housing of the munition, and/or a carrier for the munition.

One or more electroacoustic transducers may be located either side of a physical barrier.

At least the processor, and optionally at least one electroacoustic transducer, is located inside the munition, or inside a carrier for the munition.

The system may comprise an electroacoustic transducer, arranged to receive an acoustic signal, and convert that signal into an electrical signal, and that electrical signal is used to power a part of the system. Optionally, the electroacoustic transducer is the same electroacoustic transducer that is used to receive the acoustic signal comprising data, and convert that signal into the electrical signal comprising data The electrical signal may be arranged to power the processor or a component connected to the processor.

The data may comprise an address, for addressing a part of the munition, or for addressing a munition amongst multiple munitions contained in a single carrier.

According to a second aspect of the invention, there is provided a munition comprising the programmable system of the first aspect.

The munition may be a submunition, for example carried or carriable by a carrier.

According to a third aspect of the invention, there is munition assembly, the assembly comprising: a carrier for a submunition, the carrier comprising a cavity in which the submunition is located; and a submunition, carried by the carrier in the cavity, the submunition arranged to be controllably expelled from the carrier; the submunition comprising: a submunition explosive charge; a submunition fuze; and the programmable system of the first aspect, and wherein the munition assembly is adapted to be launched, and where the submunition is then arranged to be controllably expelled from the carrier; and the submunition fuze is adapted to trigger the submunition explosive charge.

The assembly may be adapted to be launched, into the air, from a gun barrel.

The submunition may then be arranged to be controllably expelled from the carrier and enter a body of water; and the submunition fuze is adapted to trigger the submunition explosive charge underwater.

According to a fourth aspect of the invention, there is provided a programming method for a munition, the method comprising: receiving an acoustic signal comprising data at the munition, and converting that signal into an electrical signal comprising data; receiving and processing the electrical signal comprising data, and using that data in programming of the munition.

More generally, any one or more features described in relation to any one aspect may be used in combination with, or in place of, any one or more feature of any one or more other aspects of the invention, unless such replacement or combination would be understood by the skilled person to be mutually exclusive, after a reading of the present disclosure.

For a better understanding of the invention, and to show how embodiments of the same may be carried into effect, reference will now be made, by way of example, to the accompanying diagrammatic Figures in which:

FIG. 1 schematically depicts a vessel launching a munition into the air, from a gun barrel, in accordance with an example embodiment;

FIG. 2 shows the munition of FIG. 1 being directed towards a body of water, in accordance with an example embodiment;

FIG. 3 schematically depicts different approaches to slowing the munition in the air, before entering into the water, in accordance with example embodiments;

FIG. 4 schematically depicts how the fuze may be adapted to initiate the main charge of the munition, under the water, in accordance with a particular criteria, according to example embodiments;

FIG. 5 schematically depicts how the fuze may be adapted to initiate the main charge of the munition, under the water, in accordance with another criteria, according to other example embodiments;

FIG. 6 schematically depicts how the fuze may be adapted to initiate the main charge of the munition, under the water, in accordance with another criteria, according to other example embodiments;

FIG. 7 schematically depicts an artillery shell according to an example embodiment, including a munition according to an example embodiment;

FIG. 8 schematically depicts general methodology associated with the implementation of example embodiments;

FIG. 9 schematically depicts a reconnaissance projectile, in accordance with an example embodiment;

FIG. 10 schematically depicts operating principles associated with the reconnaissance projectile of FIG. 9, according to an example embodiment;

and

Figure 15:
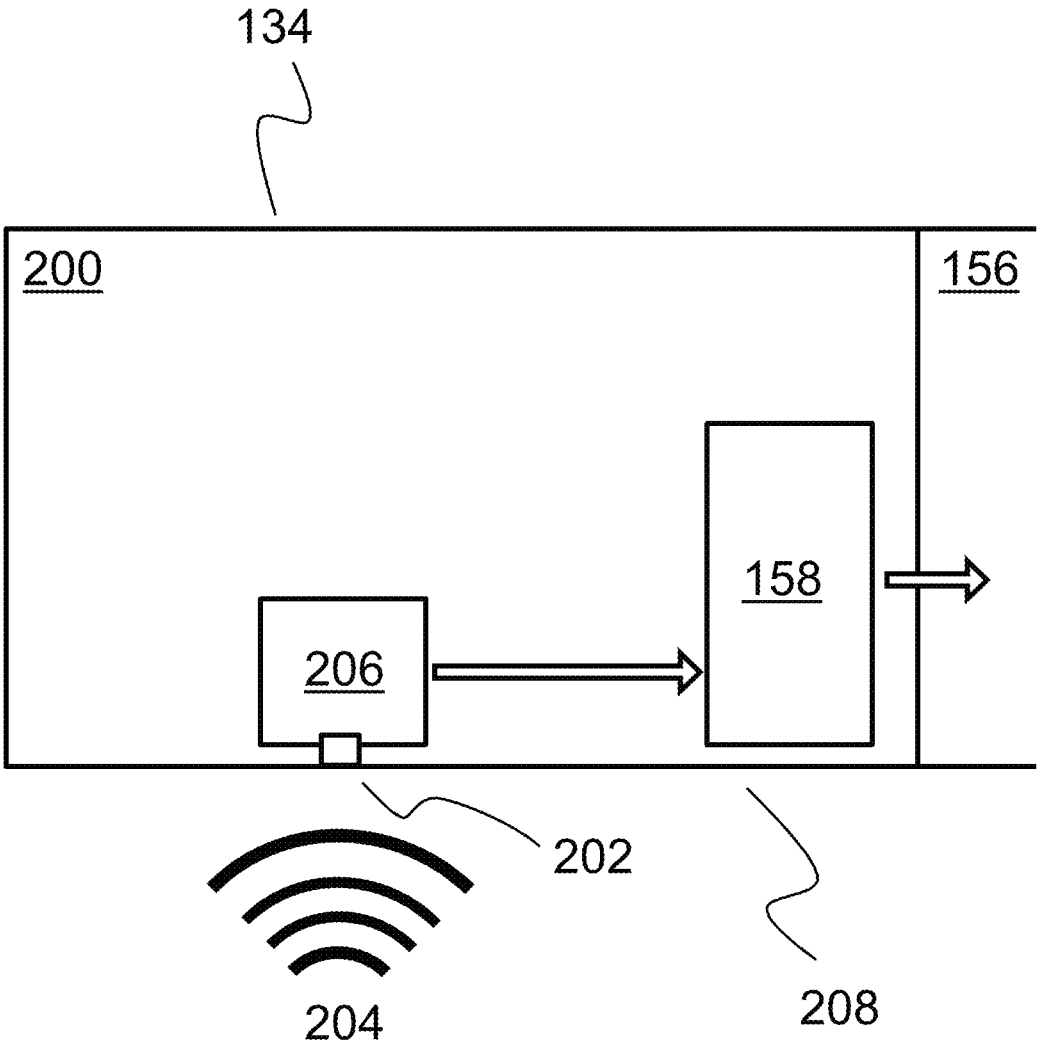
FIG. 15 shows a simplified representation of the submunition of FIG. 14, but with a more detailed view of a related fuse system for this munition in accordance with an example embodiment.
Figure 16:
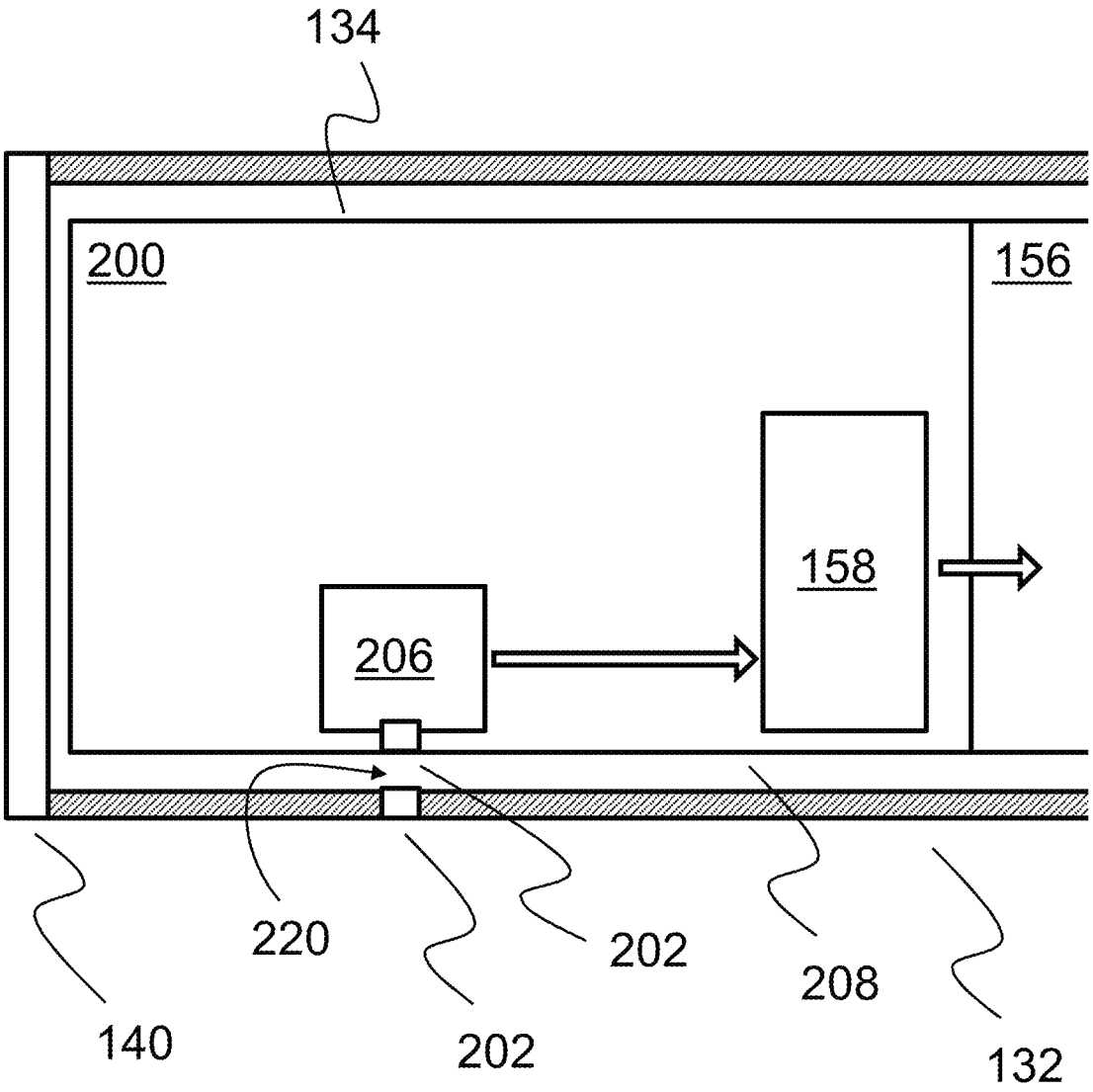
FIG. 16 shows a simplified representation of the submunition and carrier of FIG. 14, but with a more detailed view of a related fuse system for this munition, in accordance with an example embodiment.
Figure 17:
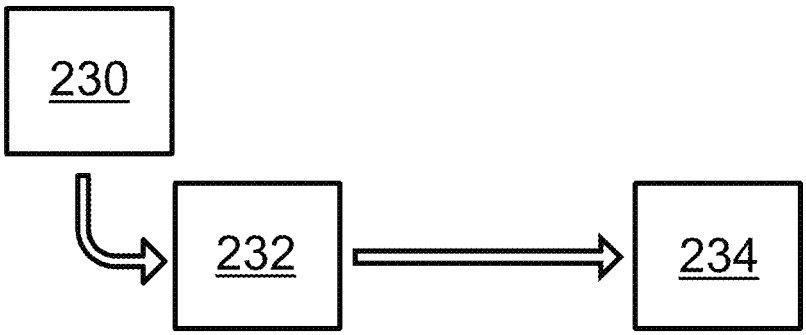

FIG. 17 schematically depicts general methodology associated with the operation of the systems shown in and in reference to FIGS. 15 and 16.

As discussed above, there are numerous disadvantages associated with existing apparatus and methods for engaging underwater targets. These range from the limited range of some existing munitions used for such purposes, to the limited accuracy of existing munitions, or the significant expense associated with existing munitions. In general, there is exists no relatively inexpensive, rapidly deployable, and yet long-range and accurate, munition, or related assembly or methodology, for engaging or generally interacting with underwater objects (e.g. targets).

According to the present disclosure, it has been realised that the problems associated with existing approaches can be overcome in a subtle but effective and powerful manner. In particular, the present disclosure provides a munition. The munition comprises an explosive charge and a fuze. The munition is adapted to be launched, into the air. Significantly, the munition is adapted to be launched from a gun barrel. This means that the munition typically (and practically likely) includes, or is at least used in conjunction with, a propelling explosive, and is capable of being explosively propelled and withstanding such explosive propulsion. This is in contrast with, for example, a depth charge, or torpedo. Being launched from a gun barrel, this is also in contrast with a mortar bomb. The munition is adapted to be launched and then enter a body of water, typically within which body of water a target or object to be engaged would be located. The fuze of the munition is adapted to trigger the explosive charge of the munition under water, for example in accordance with pre-set criteria. The use of a gun barrel also ensures high degree of accuracy in terms of ranging and general targeting.

The disclosure is subtle but powerful. The disclosure is subtle because it perhaps takes advantage of some existing technologies, in the form of firing a munition from a gun barrel. This means that the range of the munition would be hundreds of metres, or even kilometres, overcoming range problems associated with existing apparatus or methodology. At the same time, the munition will typically be a projectile, therefore being unpropelled and/or including no form of self-propulsion. This means that the munition is relatively simple and inexpensive. Altogether then, this means that the munition according to example embodiments can be used to accurately, cheaply, effectively, and generally efficiently engage with targets located at quite some distance from an assembly (e.g. a platform, vessel, vehicle, and so on, or a related gun) that launches the projectile. Also, the use of a munition that is capable of being launched from a gun barrel means that multiple munitions can be launched very quickly in succession from the same gun barrel, or in succession and/or in parallel from multiple gun barrels, optionally from different assemblies, or optionally being targeted onto or into the same location/vicinity of the same body of water. Again then, target engagement efficiency and effectiveness may be increased, in a relatively simple manner.

Figure 1:
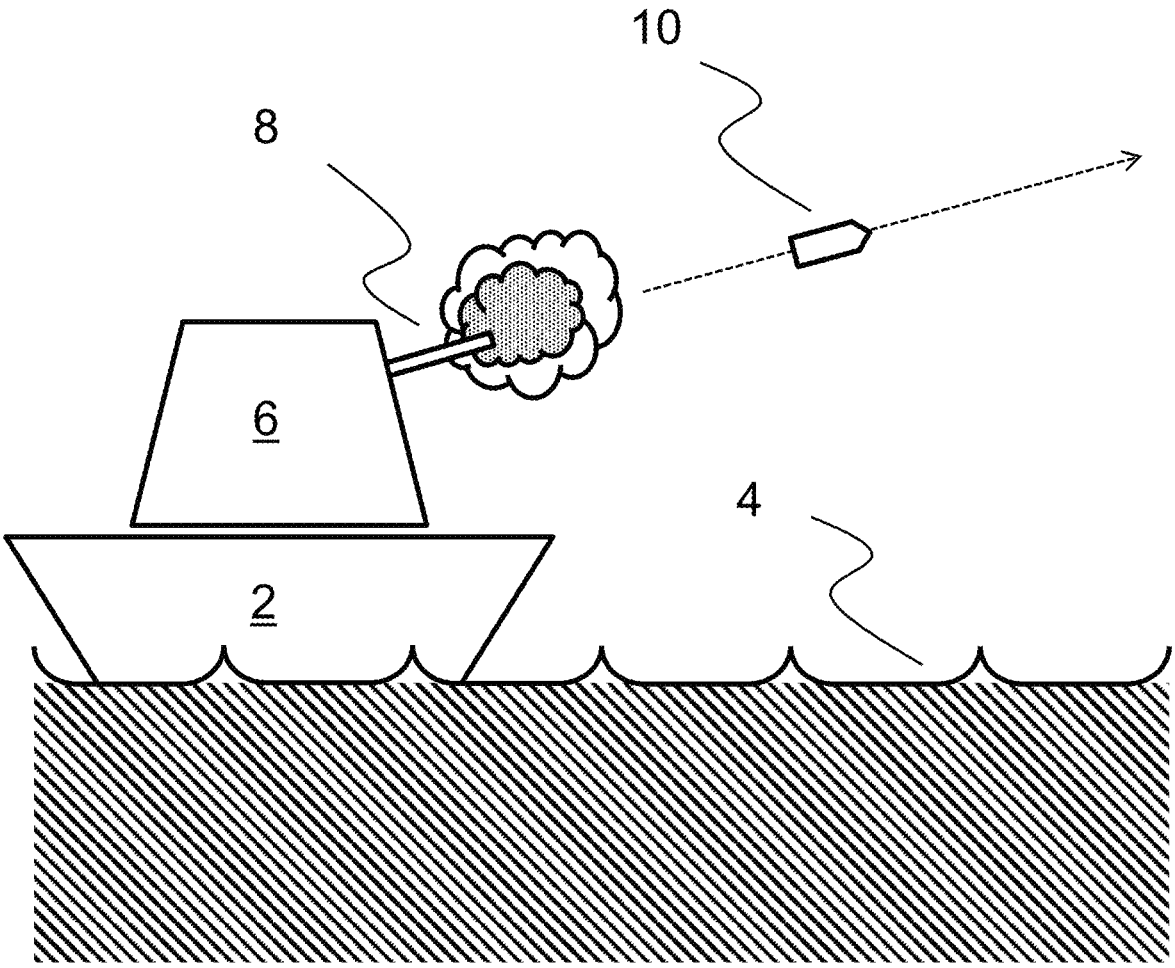

FIG. 1 schematically depicts an assembly in accordance with an example embodiment. In this example, the assembly comprises a vessel 2 located on a body of water 4. The vessel comprises a gun 6 having a gun barrel 8. In another example, the assembly need not include a particular vehicle, and could simply comprise a gun.

The munition 10 is shown as being explosively launched into the air. As discussed above, this gives the munition 10 significant range, and accuracy at range.

Prior to being launched into the air, the munition 10 (or more specifically its fuze) might be programmed in some way. The programming might take place within the gun 6, within the barrel 8, or even within a particular range after launch of the munition 10, for example by a wireless transmission or similar. The programming might be undertaken to implement or change particular fuze criteria, for example to trigger explosive within the munition 10 in accordance with particular criteria. This will be explained in more detail below. Typically, in order to achieve this programming, the munition 10 will comprise a programmable fuze. That is, the fuze is able to be configured.

As is typical for munitions fired from a gun barrel, the munition will typically be arranged to be launched from a smooth bore gun barrel. Optionally, the munition may be fin-stabilised. Alternatively, the munition may be arranged to be launched from a rifled bore. The exact configuration will be dependent on the required application.

As discussed throughout, care will need to be undertaken to ensure that the combination of munition properties (e.g. size, weight, shape and so on) and launch specifications (e.g. explosive propulsion) is such that the munition 10 does not explode on launch. This might require particular care to be given to the explosive resistance of the munition 10, or at least constituent parts located within the munition, typically associated with initiating an explosion of the munition 10. Such concepts will be known or derivable from munitions technologies typically involved in gun-based launching.

Figure 2:
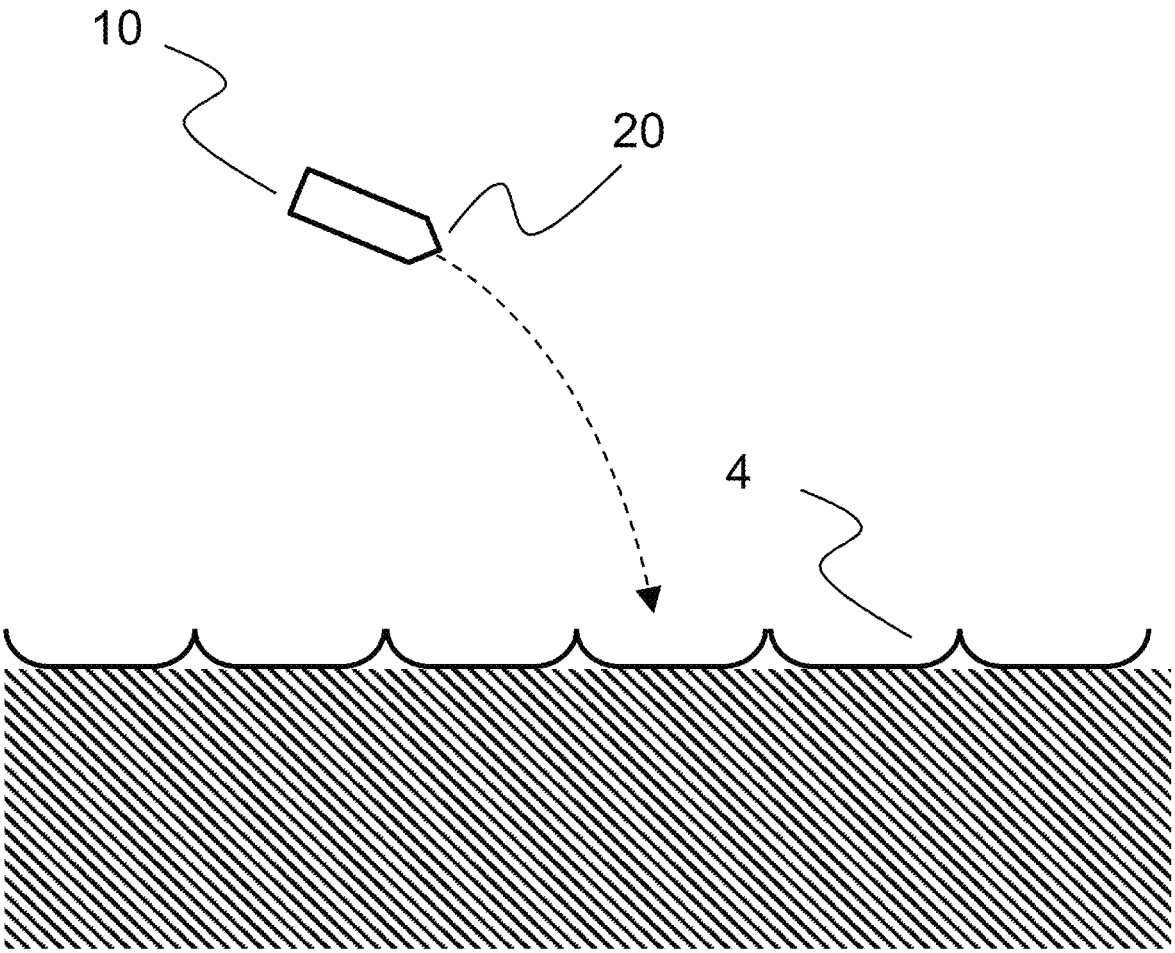

FIG. 2 shows the munition as it is directed to and is about to enter the body of water 4. Having been explosively launched from a gun barrel 8, the munition 10 will enter the body of water 4 with significant speed. In a practical implementation, care will need to be undertaken to ensure that the combination of munition properties (e.g. size, weight, shape and so on) and impact speed with the water 4 is such that the munition 10 does not explode on impact. This might require particular care to be given to the impact resistance of the munition 10, or at least constituent parts located within the munition, typically associated with initiating an explosion of the munition 10.

In one example, a simple but effective feature which may assist in this regard is the head or tip 20 of the munition being ogive-shaped or roundly-shaped or tapering, in accordance with the typical shape of munitions. Again, this is in contrast with a depth charge or similar. However, this may not be sufficient in isolation, or even in combination with structural impact-resistant features of a munition, to prevent explosion of the munition 10 on impact with the water, or to damage the munition such that it does not work satisfactorily under the water 4.

Figure 3:
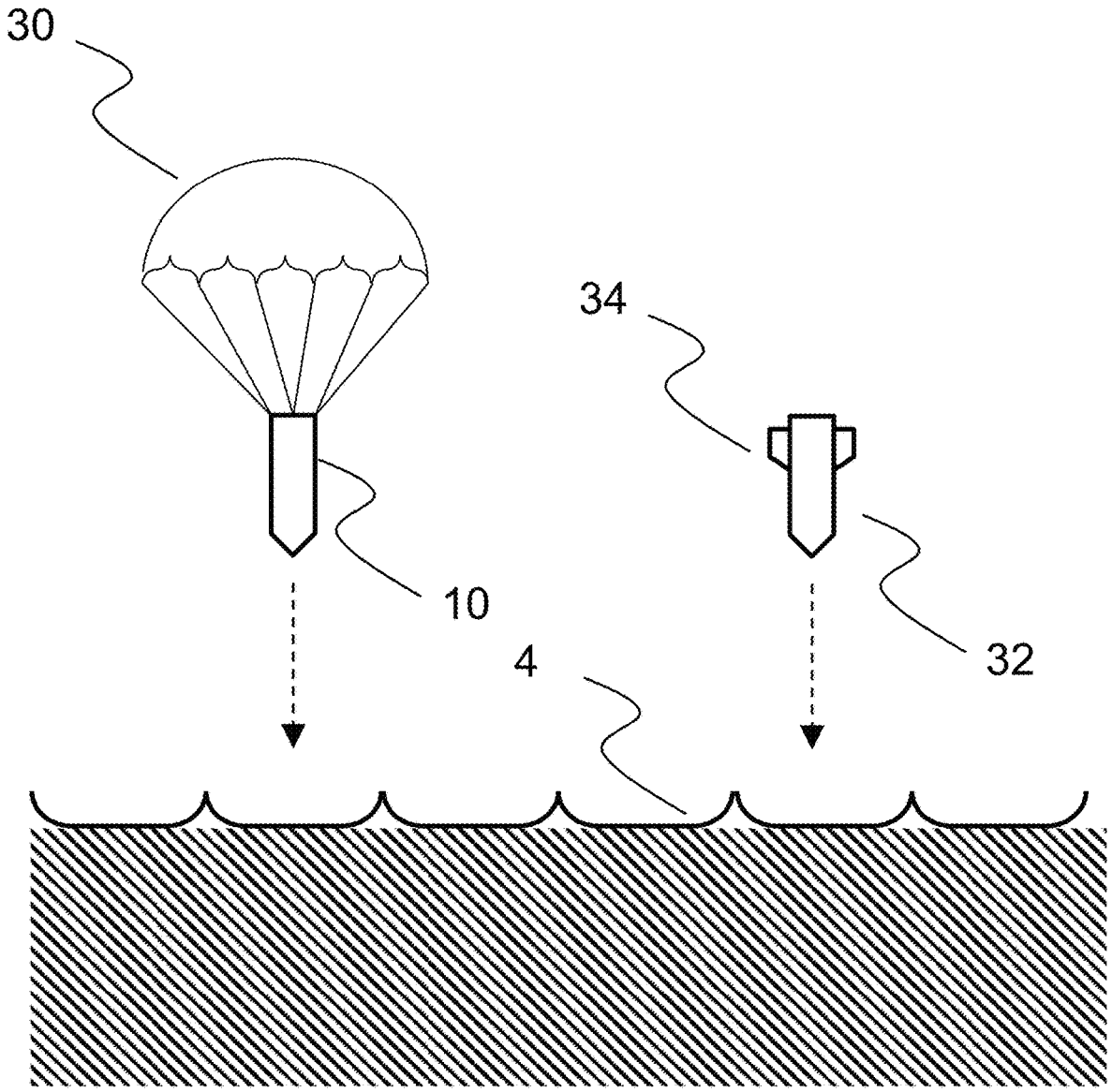

FIG. 3 shows that in addition to, or alternatively to, an impact resistant or accommodating structure of the munition 10, the munition 10 may be provided with a deployable configuration that is arranged, when deployed, to slow the munition 10 in the air before entry into the water 4. In order to successfully engage with an underwater target described herein, the speed of decent of the munition down, through the water 4 to the target may be less important than the speed of delivery of the munition from the gun to the location at/above the target. In other words, the munition 10 does not need to enter the water 4 at a particularly high velocity. Therefore, deceleration of the munition 10 prior to entering the water 4 is acceptable, and may actually be desirable. That is, slowing the munition 10 prior to entering the water 4 may be far simpler or easier to achieve than designing the munition to withstand high speed impact with the water 4. This is because such a design might mean that the cost of the munition is excessive, or that the weight of the munition is excessive, or such that the space within the munition for important explosive material is reduced. In other words, some form of air brake might be advantageous.

FIG. 3 shows that, in one example, the deployable configuration could comprise a parachute 30. The parachute could be deployed after a certain time from launch of the munition 10, or could, with appropriate sensing or similar, be deployed upon particular distance proximity sensing with respect to the water 4.

In another example, a similar munition 32 is shown. However, this similar munition 32 comprises a different deployable configuration in the form of one or more deployable wings or fins 34. These deployable wings or fins 34 may be deployed in the same manner as the parachute 30 previously described. The wings or fins 34 might optionally provide a degree of auto rotation to slow or further slow the munition 32. As discussed above, it is desirable for the munition to reach the location of the target object, or its surrounding area quickly and effectively, while at the same time being relatively inexpensive and having maximum effectiveness. It is therefore desirable not to pack the munition with complicated or advanced guiding or directionality mechanisms, which might be used to control the directionality of the descent of the munition. However, in some examples the fins and/or wings 34 previously described may be controllable to provide directional control of the descent of the munition 32, for example via a moveable control surface provided in or by the fins or wings. Such control is typically not to be used during projectile-like flight of the munition 32, for example immediately after launch, but instead might be used for a degree of tuning control of the descent of the projectile into the body of water. This might improve engagement accuracy and effectiveness with a target located in the body of water 4. However, as alluded to above, in other examples the munition according to example embodiments may be free of such directional (descent) control, to ensure that the cost and complexity of the munition is minimised, and such that any related cost or space budget is taken up with more core aspects, such as volume of explosive.

After entering the body of water, the munition may be arranged to retract or dispose of the deployable configuration, so that the deployable configuration does not slow (or slow to too great an extent) the descent of the munition toward the target. For similar reasons, the munition might be free of any such deployable configuration, such that there is no impact on descent in the water. Descent through the water may need to be as fast as possible (e.g. to avoid the object moving to avoid the munition).

Figure 4:
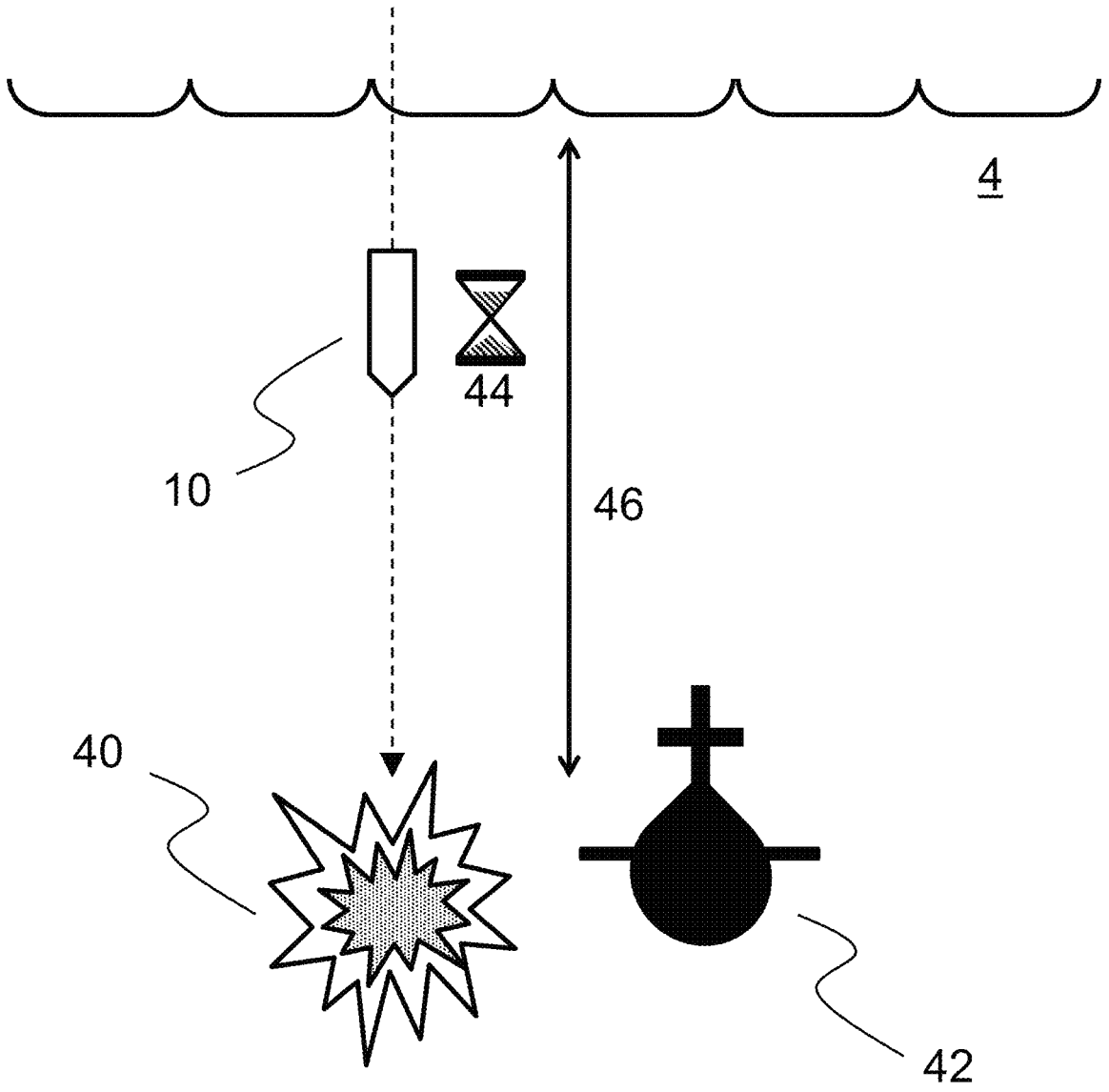
Figure 5:
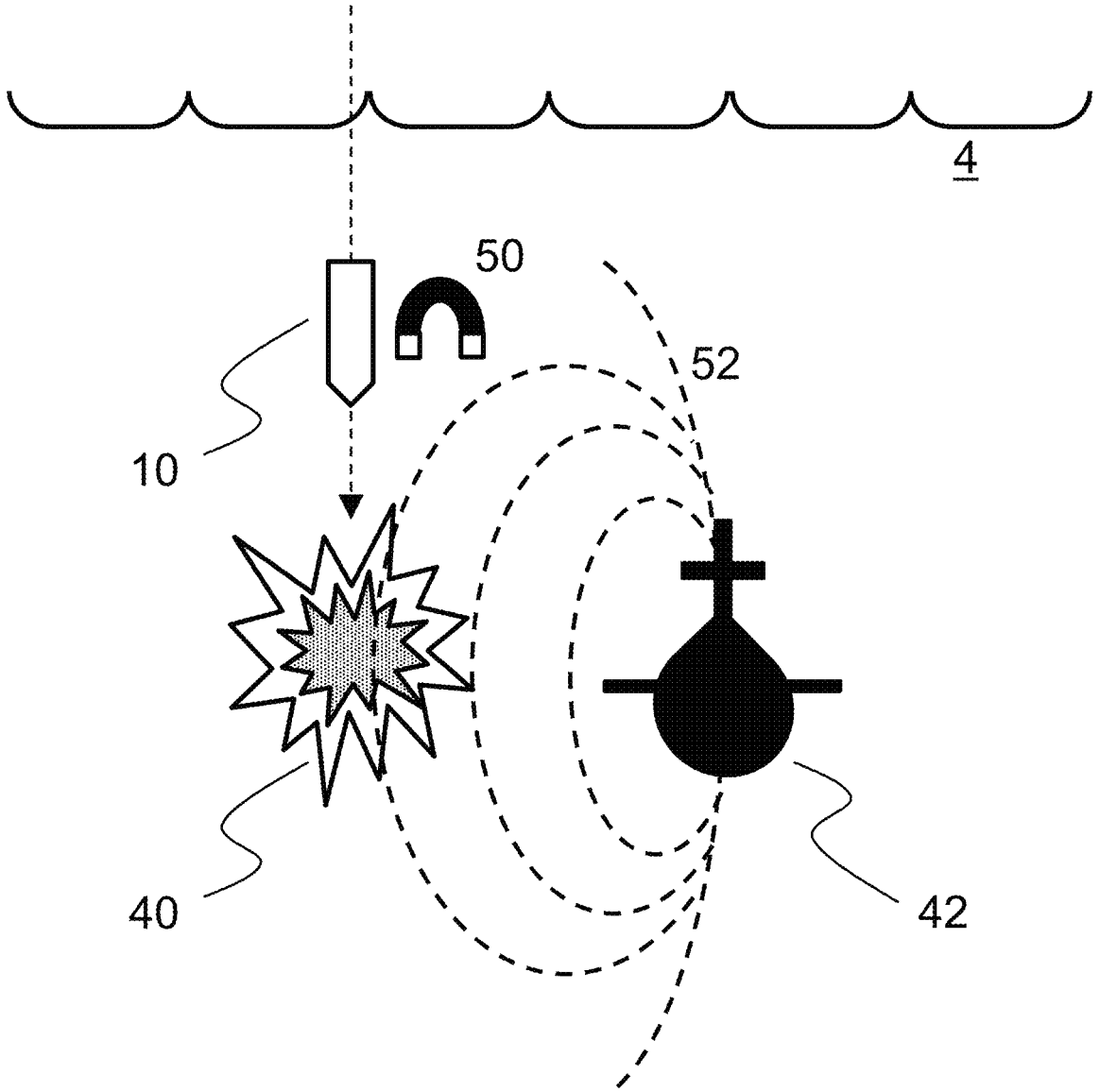
Figure 6:
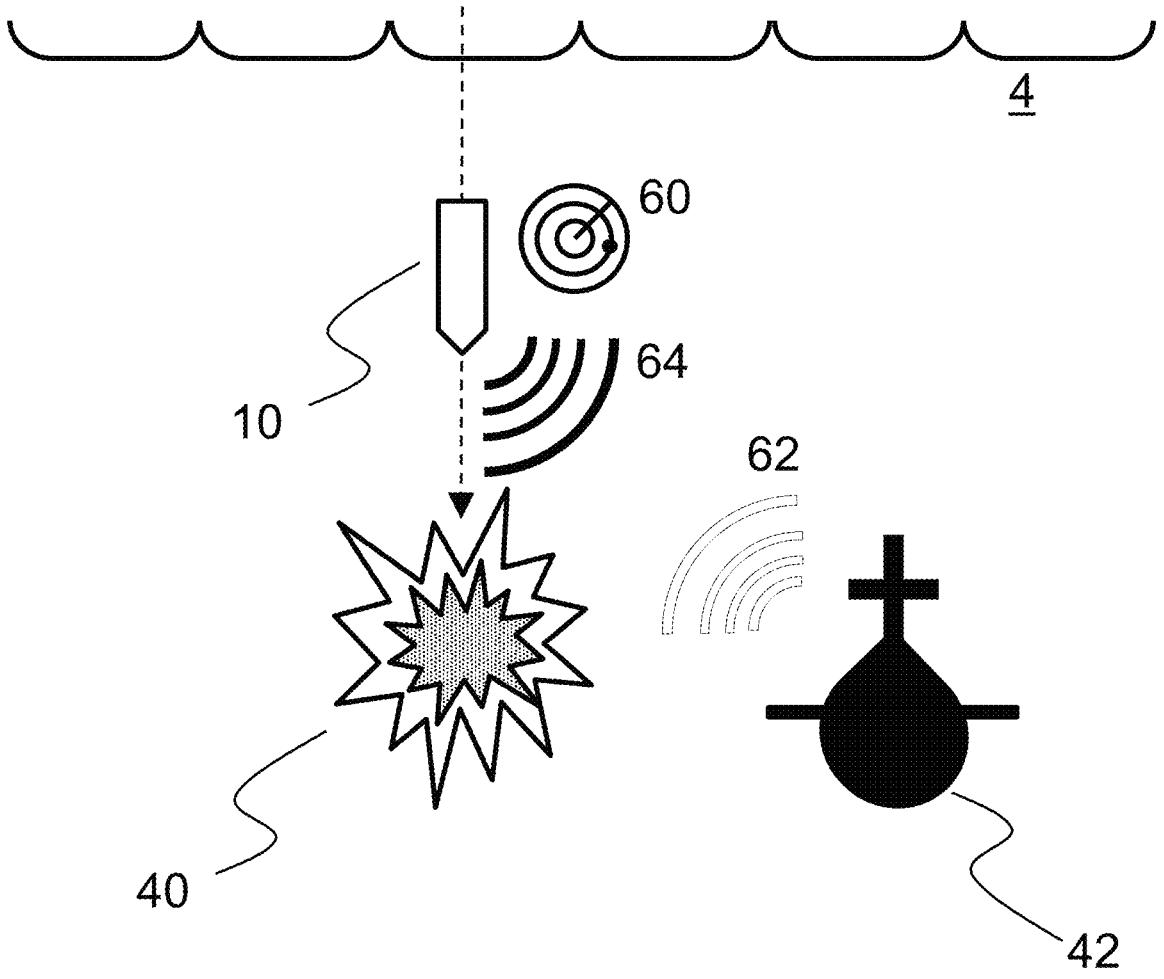

After entering the body of water, the munition will descend within the body of water. The fuze within the munition is adapted to trigger the explosive charge within the munition in the water (that is under the water surface). This triggering can be achieved in one of a number of different ways. FIGS. 4 to 6 give typical examples.

FIG. 4 shows that the fuze may be adapted to trigger 40 explosive within the munition 10 in order to successfully and effectively engage an underwater target 42. This might be achieved by triggering the explosive charge after a particular time 44, for example from one or more of a combination of launch from the gun barrel described above, and/or a predetermined time period after entering the water 4. This time period will typically equate to a particular depth 46 within the water 4 (e.g. based on expected or calculate rate of descent). Alternatively, the triggering 40 may occur at the particular depth 46 in combination with or irrespective of the timing 44. For example, an alternative or additional approach might involve the direct detection of depth (via one or more sensors or similar). Depth may be detected based on time, as above, or perhaps based on water pressure under the surface, the salinity of the water, the temperature of the water, or even at a predetermined speed-of-sound in the water. All of these may be indicative of depth within the water, for example which may be known in advance from mapping of the area, and/or sensed by the munition 10 via one or more sensors when descending through the water.

Of course, the fuze may be also be adapted to trigger the explosive charge upon impact with the target 42. However, it may be safer to employ some form of depth-activation, so that the munition explodes at/near the depth of the target, avoiding possible unintentional explosions at or near objects that are not targets.

As above, the fuze may be programmed with such criteria, or related criteria necessary for the fuze to trigger the explosive as and when intended.

FIG. 5 shows a different adaptation for triggering 40 an explosive charge of the munition 10 under the water, this time upon magnetic detection 50 of a target magnetic signature 52. In a crude sense, the target magnetic signature could simply be the detection of anything magnetic, indicating the presence of a magnetic or magnetisable structure. For instance, once a detected magnetic a field strength is above a relevant threshold, the munition 10 might explode. In a more sophisticated manner, it may be known or derivable in advance to determine what the expected magnetic signature 52 of the particular target 42 might be, might look like, or might approximate to. This might equate to field strength, or field lines, or changes therein. In this example, the munition 10 might not be triggered 40 to explode until the magnetic detection 50 detects a very particular magnetic signature 52, and not simply any magnetic field or change therein.

While FIG. 5 discusses the use of magnetic fields, much the same principle may be used to detect electric field signatures. FIG. 6 shows another example of triggering. In this example, the triggering 40 of the explosive charge in the munition 10 is undertaken based on the detection of pressure waves in the water 4, thereby implementing a sonar-like system 60. The system may be implemented in one of a number of different ways. In one example, the munition 10 may be arranged to detect a pressure wave 62 emanating from target object 42. This could be a sonar pulse 62 originating from the object 42, or simply detection of sound generated by the object 42, or could instead be a reflection 62 of a sonar pulse 64 originating from the munition 10. That is, the projectile 10 may not only detect pressure waves, but may emit pressure waves. As with the magnetic field examples given above, the explosive charge may be triggered 40 when a target sonar signature is detected 60, and this could be when any pressure wave is detected, or more likely when a pressure wave above a certain threshold is detected, or when a particular pressure wave or a series of pressure waves is detected which is indicative of the presence of a particular target 42.

In general, the munition may be able to detect or infer entry into the water, or making contact with the water. This might be useful in initiating or priming fuze activity, for example starting a timer, taking a base or initial reading of pressure, salinity, temperature, and so on (or any relevant criteria), or anything which may assist in the subsequent use of the fuze to trigger the explosive. This sensing or inference could be via an environmental sensor or similar that is (already) present in order to perform another function, for example those discussed or alluded to above. Alternatively, the sensing or inference could be via a dedicated sensor, for example a dedicated impact or water/moisture sensor, or temperate sensor, pressure sensor, salinity sensor, and so on. In general terms, the munition may be able to detect or infer entry into the water, or making contact with the water, for safety reasons, where some (e.g. explosive) function is prevented prior to water contact/entry.

Figure 7:
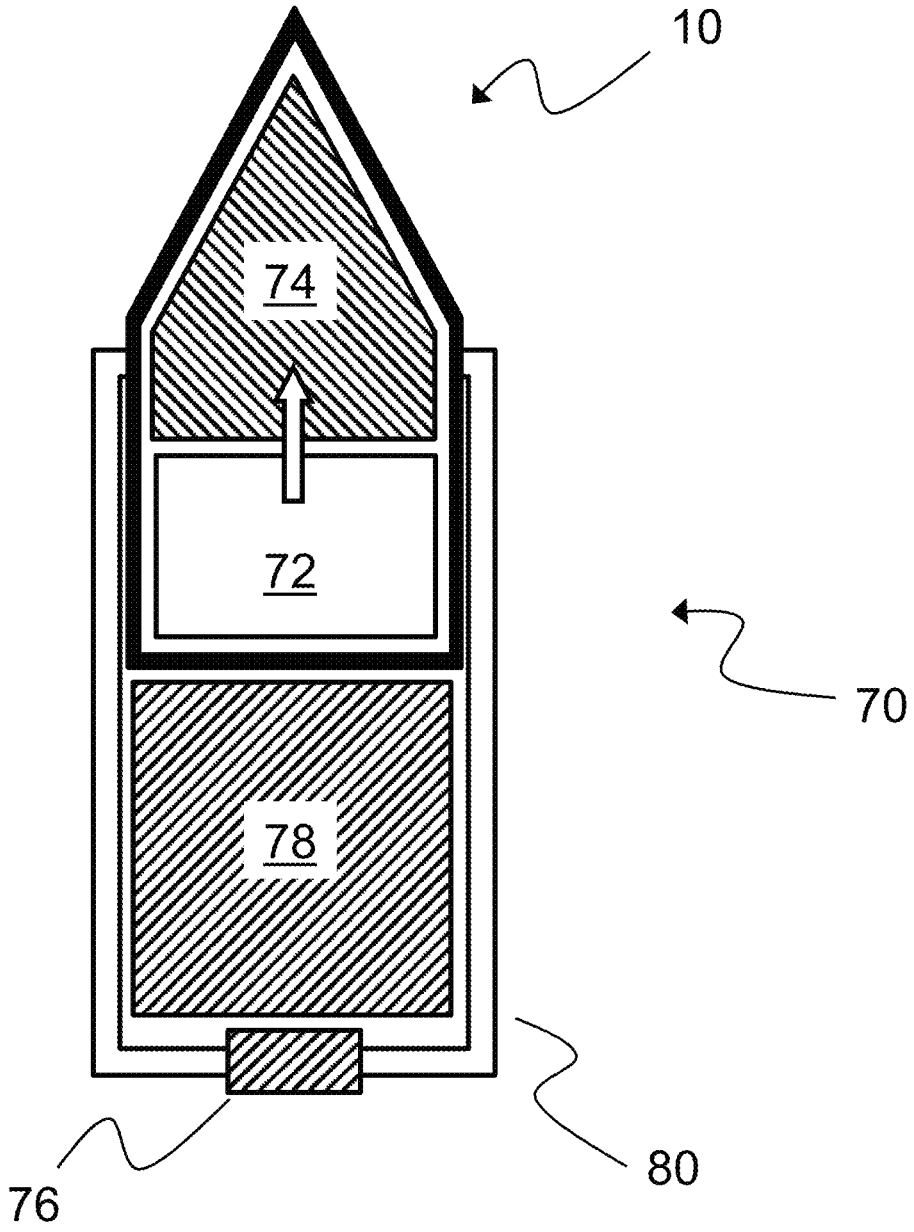

As discussed above, a main principle discussed herein is that the munition is adapted to be launched, into the air, from a gun barrel. This gives good range, and good targeting accuracy, good engagement speed, all at relatively low cost. To this extent, the munition may be described as, or form part of, an artillery shell. FIG. 7 shows such an artillery shell 70. The artillery shell 70 comprises a munition 10 according to any embodiment described herein. The munition 10 will typically comprise a fuze 72 (likely a programmable fuze, as discussed above), which is adapted to trigger an explosive charge 74 also located within a munition. The artillery shell 70 will also comprise a primer 76 and an explosive propellant 78 which may be cased (as shown) or bagged. A casing 80 might also be provided, to hold the munition 10, explosive 78, and primer 76.

In another example, and typical in munitions, the fuze could be located in the nose of the munition (e.g. as opposed to behind the nose as shown in FIG. 7).

It is envisaged that a practical implementation of concepts of the present disclosure would take the form of the artillery shell of FIG. 7, or something similar to that depiction, as opposed to a munition in isolation. In any event, as discussed above, the munition according to the present disclosure is capable of withstanding explosive propulsion-based launch from a gun barrel, in contrast with for instance a depth charge or torpedo. The munition and/or artillery shell (which could be the same thing) will typically have a diameter of 200 mm or less, in contrast with depth charges. The gun barrel-munition/artillery shell assembly typically will be such that the munition has a range of well over 100 metres, typically over 1000 metres, and quite possibly in excess of 20 to 30 kilometres. Again, this is in contrast with a depth charge and a mortar bomb. Balanced with the ranging and target accuracy that launching from a gun barrel gives, the munition will be projectile-like, that is not including any self-propulsion, in contrast with a torpedo or similar. To summarise, then, the approach described above allows for relatively cheap, accurate, rapid, effective and efficient engagement of underwater targets at a significant range. One or more assemblies can be used to launch one or more munitions with such range and effectiveness, in contrast with the launching of depth charges, helicopters including such depth charges, or multiple torpedoes.

Figure 8:
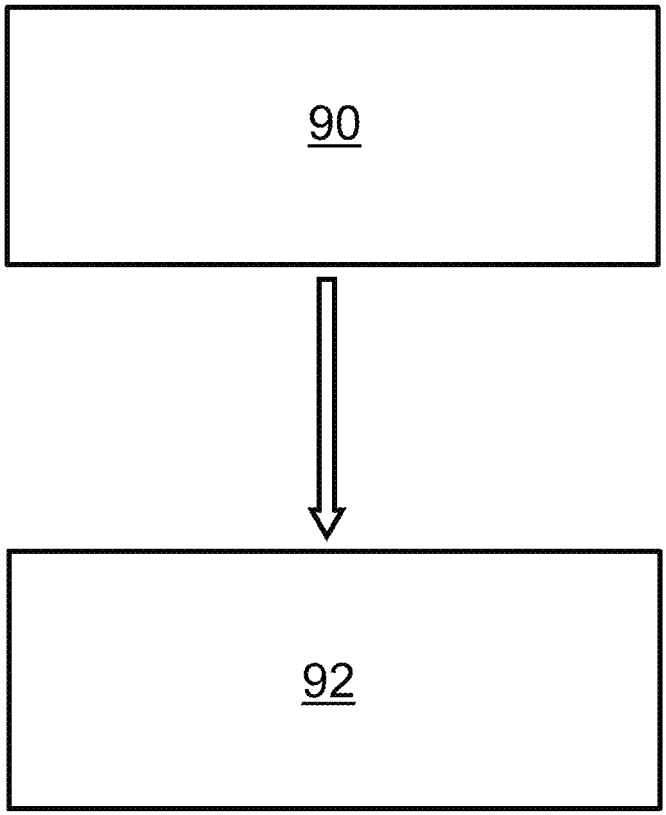

FIG. 8 schematically depicts general principles associated with the method of launching a munition according to an example embodiment. As discussed above, the munition comprises an explosive charge, and a fuze. The munition is adapted to be launched, into the air, from a gun barrel, and enter a body of water. The fuze is adapted to trigger the explosives charge under the water. Accordingly, the method comprises launching the munition into the air, from a gun barrel 90. The launch is configured such that the munition is launched into the body of water 92, such that, as discussed above, the fuze may then be adapted to trigger the explosive charge under the water 92.

In the embodiments discussed above, a munition has been described and detailed. The munition includes an explosive charge. However, in accordance with alternative embodiments, many of the principles discussed above can still be taken advantage of, but without using a projectile including an explosive charge. That is, the above principles can be used to ensure that a projectile can be launched from a gun barrel and into a body of water, when the projectile is then arranged to interact or engage with an object in the water, but without necessarily including an explosive charge to disable or damage that object. In particular, the present disclosure additionally provides a reconnaissance projectile. The reconnaissance projectile is adapted to be launched, into the air, from a gun barrel, and then into contact with a body of water (onto the water surface, or to descend below the surface). Again then, the projectile may be launched at a high range, with a high degree of accuracy, relatively cheaply and quickly. The reconnaissance projectile is arranged to initiate a reconnaissance function when in contact with the body of water (which includes when impacting the water, when on the body of water, or, as above, typically when located under the surface of the water). The reconnaissance function could be anything of particular use in relation to the particular application, but would typically comprise emission and/or detection of a pressure wave in the body of water, in a manner similar to that discussed above in relation to FIG. 6.

Figure 9:
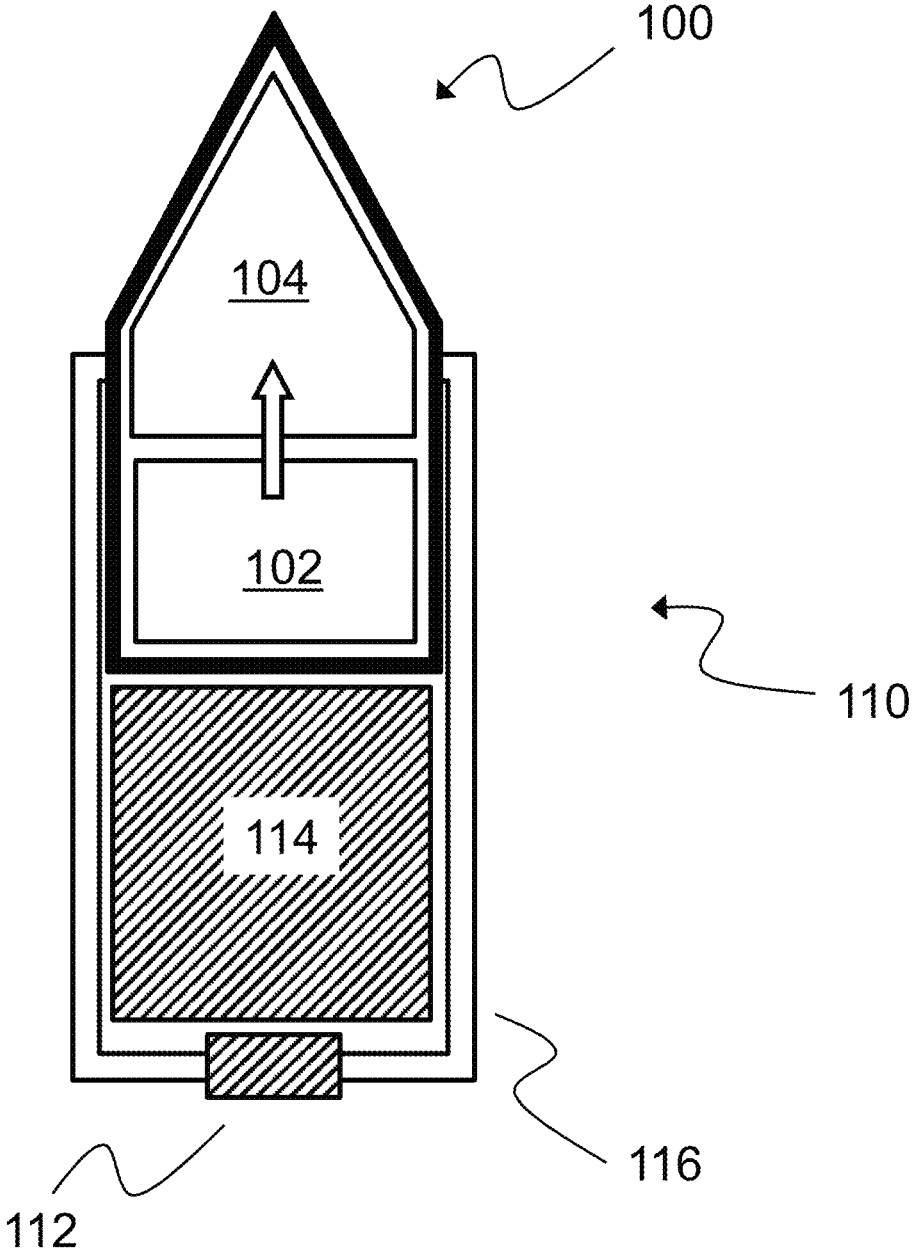

FIG. 9 shows a reconnaissance projectile 100 in accordance with an example embodiment. The reconnaissance projectile 100 comprises a sensor 102. The sensor may be used to detect when the projectile 100 has come into contact with a body of water, and/or provide some other sensing functionality, for example one or more of the sensing or initiation criteria described above in relation to the munition. For example, the sensor 102 may be arranged to detect a particular passage of time, or a particular pressure change, or particular depth, and so on. The reconnaissance projectile 100 also comprises a transceiver 104, in this example. The transceiver may be arranged to emit and/or detect pressure waves in the body of water. The sensor 102 may initiate or process transmission or detection of the waves by transceiver 104. The sensor 102 might, instead or additionally, be or comprise a processor for processing implementing one or more of these functions.

Of course, it will be appreciated that the reconnaissance projectile may take one of a number of different forms, similar or different to that shown in FIG. 9. FIG. 9 is shown simply as a way of schematically depicting what such a projectile 100 might look like.

Much as with the munition described above, the reconnaissance projectile 100 might be used or fired or launched in isolation in some way. However, it is likely that the projectile, being explosively propelled, might take the form of, or form part of, an artillery shell 110. The artillery shell 110 might comprise much the same primer 112, explosive 114 and casing 116 as is already described above in relation to the arrangement of FIG. 7. Referring back to FIG. 9, a difference here is that the artillery shell 110 comprises a non-explosive projectile 100, as opposed to an explosive-carrying munition.

As might now be understood, it will be appreciated that some embodiments described above might be a combination of both explosive-concept, and reconnaissance-concept. For instance, it will be appreciated that the embodiments of FIGS. 5 and 6, at least, already have a degree of in-built reconnaissance, assisting in the initiation of the explosives charge.

It will be appreciated that the above explosive-recon examples could be used in isolation or combination. For instance, a reconnaissance projectile may be launched into a body of water in order to perform a reconnaissance function in relation to a target. That reconnaissance projectile may be provided with a transmitter for transmitting reconnaissance information back to the assembly from which the projectile was launched. This reconnaissance information or data may then be used in the programming of subsequently fired or launched explosive munitions according to example embodiments. Indeed, a volley of projectiles may be launched toward an underwater target in accordance with an example embodiment. One or more of those projectiles may be a munition as described herein, and one or more of those projectiles may be a reconnaissance projectile as described herein. The munitions projectile and the reconnaissance projectile may be arranged to communicate with one another. This means that, for instance, a first-fired reconnaissance projectile may enter the body of water and detect or otherwise the presence of a target, whereas a subsequently fired munitions projectile, which may be in the air or in the body of water at the same time as a reconnaissance projectile, may receive reconnaissance information from a reconnaissance projectile and use this in the initiation (or otherwise) of the explosive charge of the munitions projectile. This may mean that the munitions projectile does not need to carry sophisticated (or as sophisticated) transmission or sensing equipment, which could reduce overall cost or system complexity. Alternatively, the reconnaissance projectile described above could actually be a munitions projectile, for example one of those shown in relation to FIGS. 5 and 6. One or more munitions projectiles may be arranged to perform a reconnaissance functionality, but not necessarily initiate the explosive charge. Any acquired information on the target may be used to initiate the explosives charge of subsequently launched munitions projectiles. Or, or more reconnaissance projectiles may be arranged to perform an explosive function, but not necessarily use the reconnaissance function.

Figure 10:
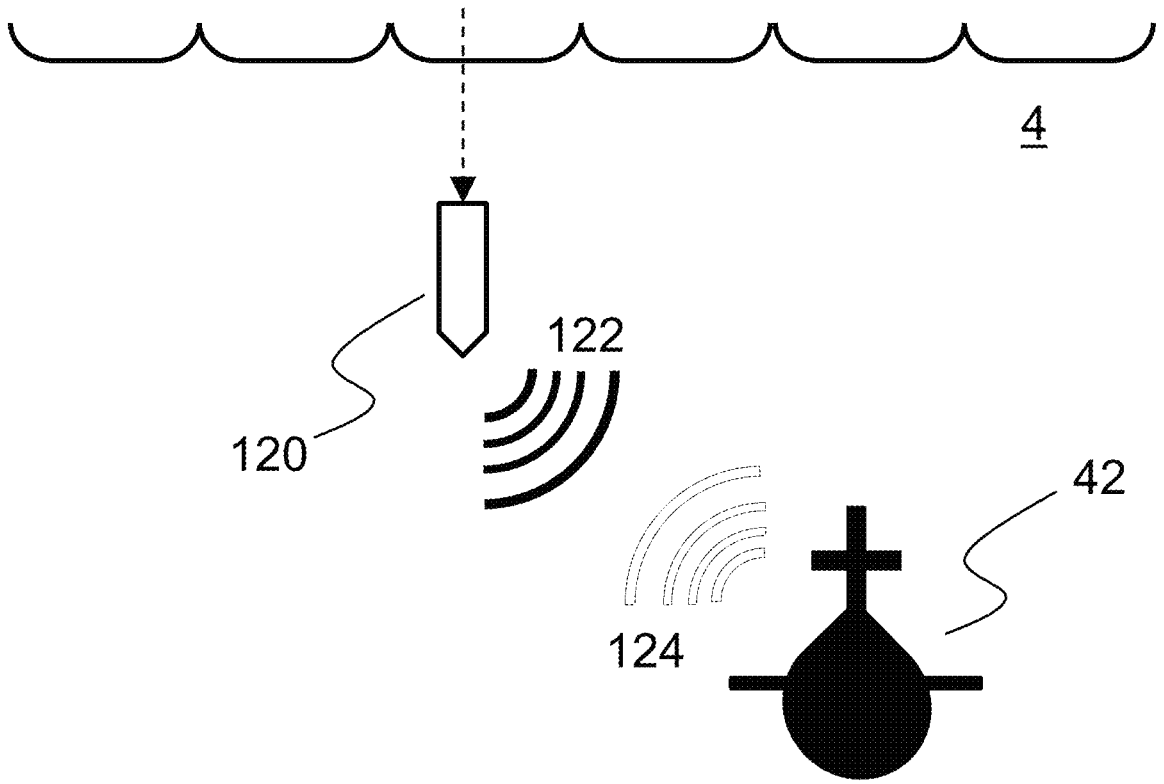

FIG. 10 shows a projectile 120 with reconnaissance functionality 122, 124 entering the body of water 4 in the vicinity of the target 42. Reconnaissance functionality 122, 124 might include emission 122 and/or detection 124 of pressure waves. As discussed previously, the reconnaissance functionality 122, 124 may be completely independent of any explosives charge that the munition 120 is, or is not, provided with. That is, the projectile 120 might have explosive capability, reconnaissance functionality, or a combination of both. Different projectiles 120 launched into the water may have different combinations of such explosive/reconnaissance functionality.

Details of the explosive, fuze and general structure of the munition will vary depending on the required application. For example, the explosive charge could be cartridged or bagged charge. The casing could be reactive. Any explosive might be dependent on how the system is to be used, for example getting the munition near the target, or simply close enough. In the former, an explosive yielding a high bubble effect might be useful. In the latter, simply the level of blast might be more important.

As alluded to earlier in the disclosure, the disclosure also relates to very closely related concepts, but in submunition or sub-projectile form, as in a munition or projectile carried by and then expelled from another (carrier) projectile. This is because further advantages can be achieved, by applying all of the above principles, but in an assembly where the munition or reconnaissance projectile is more particularly a submunition of a munition assembly, or a reconnaissance sub-projectile of a reconnaissance projectile assembly. The submunition or reconnaissance sub-projectile is the object for which controlled entry into, and functionality in, the water is achieved, whereas a carrier of the assembly is simply a tool to get the submunition or reconnaissance sub-projectile to, or proximate to, a target location.

One of the main advantages is that the assembly as a whole, and particularly an outer carrier for carrying the submunition or sub-projectile, can be well or better configured for launch from a gun, with the range and accuracy that such configurations brings. For example, the assembly or the carrier can be bullet-shaped, ogive-shaped or roundly-shaped or tapering, in accordance with the typical shape of munitions. However, and at the same time, the submunition or sub-projectile can then have any desired shape, since the submunition or reconnaissance sub-projectile does not need to be configured for being fired from a gun. This means that the submunition or reconnaissance sub-projectile can then be more easily and readily configured for controlled descent toward and into the water, reducing or preventing damage that might otherwise occur if the munition was fired directly into the water.

Whereas expulsion of the submunition or reconnaissance sub-projectile from its carrier could be achieved underwater, greater benefits are achieved by expulsion in the air, since delicate submunition or reconnaissance sub-projectile components are then not subjected to the force of entry into the water from a natural ballistic, gun-launched, trajectory. Also, the submunition or reconnaissance sub-projectile will be travelling more slowly than a 'conventional' munition, and therefore the water entry shock loading should be reduced, accordingly.

Figure 11:
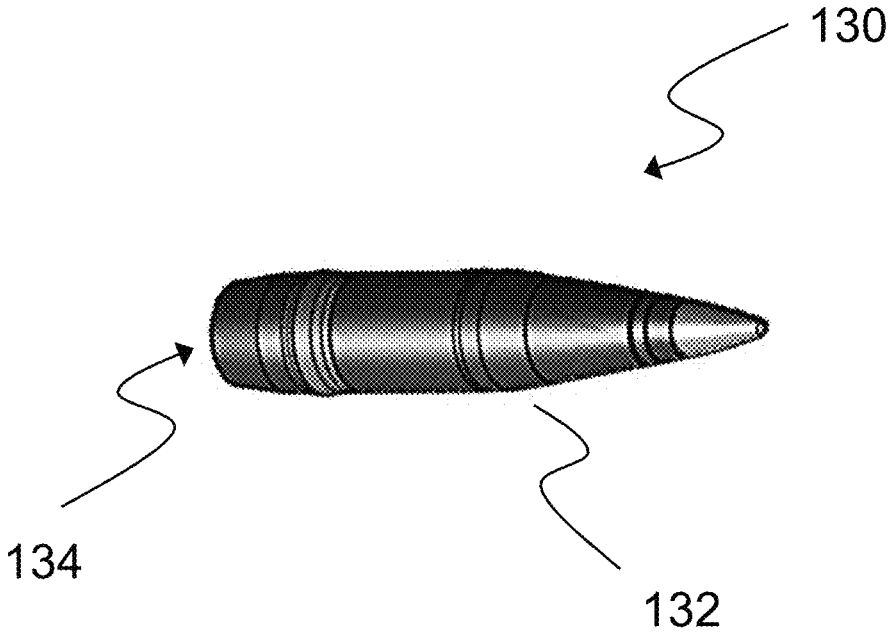
FIG. 11 shows a munition assembly, comprising a carrier and a submunition, in accordance with an example embodiment.

FIG. 11 shows a munition assembly 130, arranged to be launched from a gun, much as with the munition of previous examples. The assembly 130 comprises a carrier 132 for a submunition 134. A nose of the carrier 132 is ogive-shaped or roundly-shaped or tapering, for greater aerodynamic performance. The carrier 132 comprises (which includes defines) a cavity in which the submunition 134 is located. The cavity retains and protects the submunition 134, and so shields the submunition 134 during launch and flight conditions of the assembly 130.

The assembly 130 may be launched and generally handled much as with the munition of earlier examples. However, in previous examples, controlled descent of the entire launched projectile, in the form of the (single-bodied) munition, is implemented. In the present examples, the submunition is expelled from its carrier, and controlled descent of the submunition is implemented, in the same manner as with the munition of previous examples. Again, then, the advantage of the present examples is that munition assembly can be tailored for launch and flight conditions, and the submunition can be tailored for descent and target engagement. The two-body approach allows for tailoring of a two-part problem.

Figure 12:
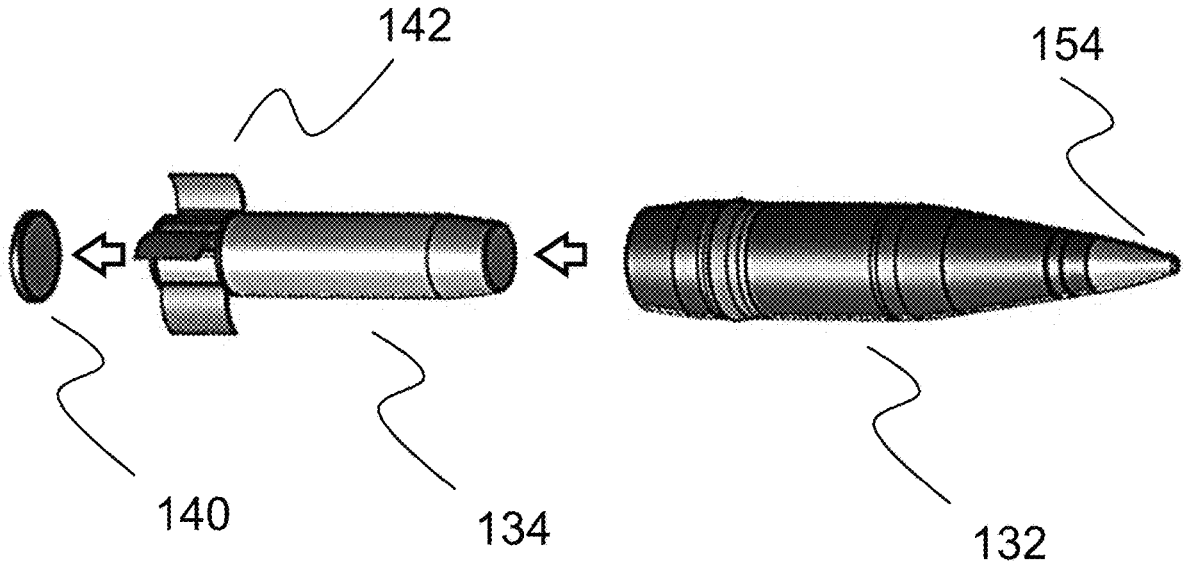
FIG. 12 shows an exploded view, and/or functionality, of the munition assembly of FIG. 11, in accordance with an example embodiment.

FIG. 12 shows that the submunition 134, initially carried by the carrier 132 in the cavity, is arranged to be controllably expelled from the carrier. This might be achieved by use of a fuze and an expulsion charge, for example a carrier fuze 154 and a carrier expulsion charge. The carrier fuze 154 may operate on a timer, triggering the carrier expulsion charge to expel the submunition at or proximate to a target location, for example above a location of a target. As with the fuze of the (sub)munition, the carrier fuze may be programmed with a particular timing, or any other set of conditions, for example location-based activation, environmental sensing-based activation, and so on.

The submunition 134 is expelled via a rear end of the carrier 132. This is advantageous, as this might better ensure the maintenance of a predictable ballistic trajectory of the submunition 134 or carrier 132, or prevent the carrier 132 from impacting upon the submunition 134. As above, it is the submunition 134 for which slow, controlled descent is desirable, and so leaving the carrier 132 via a rear end allows for much more design and functional control, in implementing this.

The submunition may be arranged to be expelled from a rear end of the carrier via a closure 140. The closure might generally close or seal off the submunition 134 within the carrier 132. This might be useful for handling or safety reasons, or assist in shielding the submunition from launch and flight conditions. The closure 140 is arranged to be opened before or during expulsion of the submunition 134. This could be an active opening, for example via a controlled electronic or pneumatic switch or opening mechanism. However, it is likely to be simpler for this opening to be relatively passive or responsive, in that the closure 140 is arranged to open, for example via a shearing action, due to pressure of the expulsion charge on the opening, either directly, or indirectly via contact with the submunition 134 itself.

As with the munition of previous examples, the submunition 134 comprises a deployable configuration 142 that is arranged, when deployed, to slow the submunition 142 in the air, after expulsion from the carrier 132, and before entry to the water. The deployment could be active, for example based on sensing of air flow or submunition release, and an electrical or mechanical system actively deploying the configuration 142. However, a more passive, automatic deployment may be simpler to implement, and more reliable. For example, FIG. 12 shows that wings or fins 142 might automatically deploy, to provide a degree of auto rotation to slow or further slow the munition 134 during its descent. The wings or fins 142 could be spring loaded, in a compressed or closed state, when in carrier 132, and then automatically uncompress or open when expulsion is implemented. Alternatively, the act of air flow during or after expulsion may force the wings or fins 142 to deploy.

Figure 13:
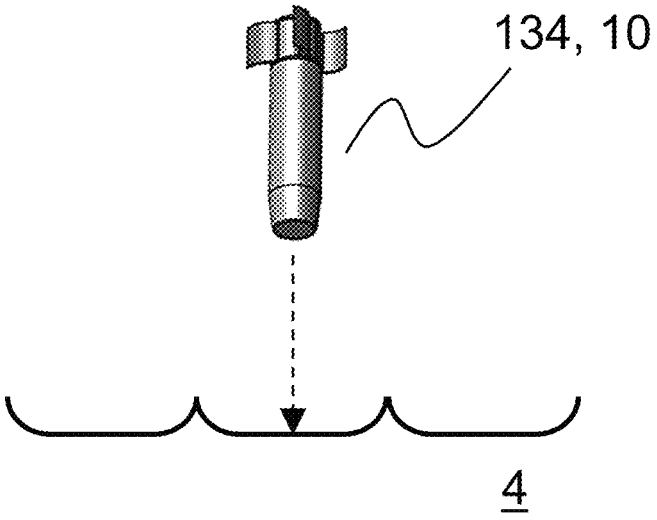
FIG. 13 shows a submunition of the munition assembly of FIG. 11, being directed towards a body of water, in accordance with an example embodiment.

FIG. 13 shows that the submunition 134 functions largely as the munition 10 of previous examples, descending toward and eventually onto or into the body of water 4, for engagement with a target. A submunition fuze is then adapted to trigger a submunition explosive charge, under water.

Figure 14:
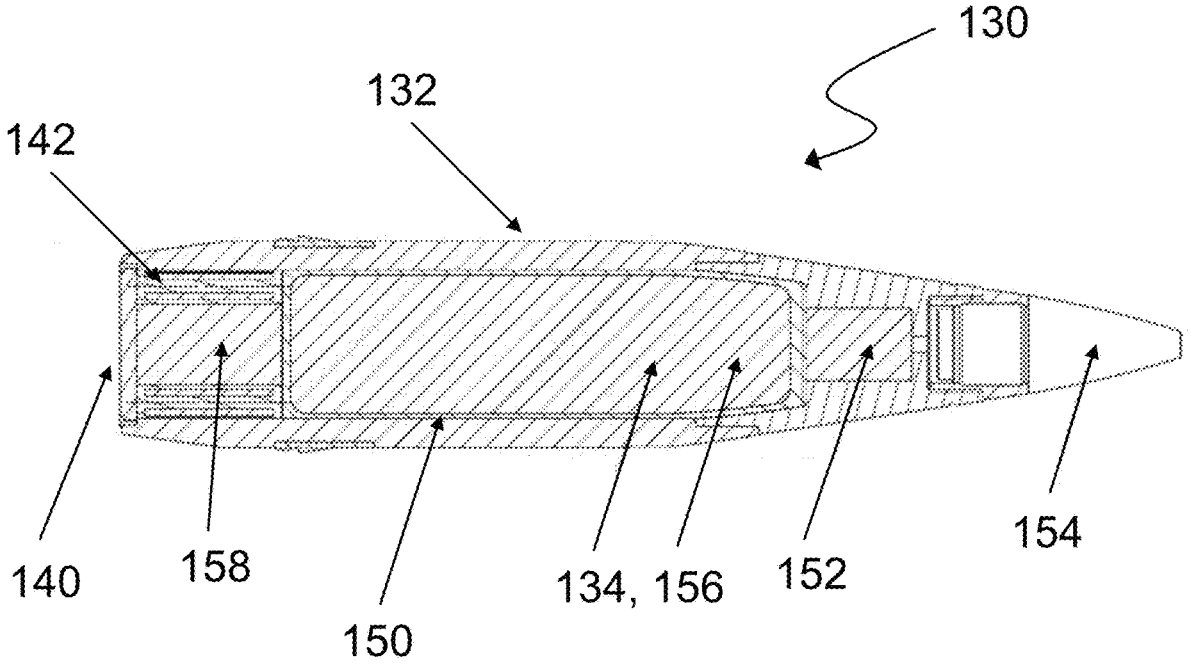
FIG. 14 shows a more detailed, cross-section, view of the munition assembly of FIG. 11, in accordance with an example embodiment.

FIG. 14 shows a more detailed view of the munition assembly 130. The munition assembly 130 is arranged to be launched from a gun. The assembly 130 comprises: a carrier 132 for a submunition 134. The carrier comprises a cavity 150 in which the submunition 134 is located. The carrier 132 may be, or may form, a (carrier) shell.

The submunition 134, carried by the carrier 132 in the cavity 150, is arranged to be controllably expelled from the carrier 134. The carrier 132 comprises a carrier expulsion charge 152 and a carrier fuze 154, the charge 152 being located in-between the submunition 134 and the fuze 154. The fuze is typically located in a nose of the assembly 130 or carrier 132. The carrier fuze 154 is adapted to trigger the carrier expulsion charge 152 to controllably expel the submunition 134 from the carrier 132, via the closure 140 at the rear of the carrier 132

The submunition 134 comprises wings or fins 142, arranged to auto-deploy upon expulsion, so as to slow down the descent of the submunition toward and into the water. Such a deployable configuration is typically located at a rear (in terms of eventual descent direction) end of the submunition, to maintain descent stability.

The submunition comprises a submunition (main) explosive charge 156, and a submunition fuze 158. The submunition fuze 158 is typically located at a rear (in terms of eventual descent direction) end of the submunition 134, to reduce the risk of damage to any sensitive components, during impact with the water. The munition assembly 130 is adapted to be launched, into the air, from a gun barrel, where the submunition 134 is then arranged to be controllably expelled from the carrier 132 and enter a body of water, and the submunition fuze 158 is adapted to trigger the submunition explosive charge 156 underwater.

Again, descent of the submunition, and activation of its fuze, may be implemented as described above in relation to the munition embodiments.

All of the principles described in relation to the submunition apply equally to a reconnaissance sub-projectile carried by a carrier of a reconnaissance projectile assembly. That is, the reconnaissance sub-projectile has the benefits of being carried and deployed like the submunition as described above, but also with the reconnaissance functionality, as described above.

Any of the projectiles described herein, including munitions, submunitions, or reconnaissance projectiles or sub-projectiles, may be arranged to communication with, or transmit to, other objects. For example, munitions, submunitions, or reconnaissance projectiles or sub-projectiles, may be arranged to transmit a communication signal, external to and away from the submunition after entering the water, and optionally after a predetermined time period after entering the water; upon detection of a target sonar signature; upon detection of a target magnetic signature; upon detection of a target electric field signature; at a predetermined pressure under the water surface; at a predetermined depth under the water surface; at a predetermined salinity of water; at a predetermined temperature of water; at a predetermined speed-of-sound in water; or upon impact with a target under the water surface. The communication with, or transmission to, could be in relation to a remote weapon or platform, which could engage with the target depending on the communication or transmission. For instance, a submunition or reconnaissance sub-projectile may provide a warning shot, or a detection function, in advance of a more escalated engagement from the remote weapon or platform (e.g. a submarine, or torpedoes from a submarine).

In the above examples, a fuze has been discussed and described quite generally. For instance, conditions have been described that may be required for the fuze to trigger the explosive charge of the munition or submunition. Typically, the fuze will form part of a wider fuze system, for example for use in arming a fuze as certain environmental conditions or properties are detected.

Some munitions rely solely on impact in order for an explosive charge to be triggered. However, many munitions are in some way programmable so that the triggering of the explosive charge can be made more controllable, for example, to be safer or more accurate. Therefore, a munition may comprise a programmable system, that is in someway programmable with data for use in facilitating certain functionality of that munition. The programmable system may be programmed before launching of a munition, during launch of the munition, or after launch of the munition, depending on the type of munition and the application of the munition.

As discussed above, there are various ways of communicating with the munition in order to facilitate such programming, for example via electrical contacts, induction principals, transmission of electromagnetic radiation, and so on. However, while all of these approaches have advantages, all of these approaches also have drawbacks. Whilst this is generally true, the drawbacks are particularly noticeable when the munition (which includes submunition) is of the type described in the above examples, where the munition or munition assemblies launch from a gun, and where the munition or submunition eventually enters a water environment and is triggered in that water. This application involves a unique and somewhat complex set of circumstances, in terms of communicating data to a fuze system of the munition. This is even more the case when the munition is a submunition located within a carrier, due to the number of physical barriers that are present between an internal environment of a submunition, and the external environment to the carrier from, which communication may originate.

According to the present invention, it has been realised that advantages may be realised by using electroacoustic principles to programme a system of a munition. In more detail, the present invention provides a programmable system for a munition. This system comprises an electroacoustic transducer, arranged to receive an acoustic signal comprising data, and convert that signal into an electrical signal comprising data. A processor is also provided and is arranged to receive and process the electrical signal comprising data, and to use that data in programming of the programmable system.

The use of electroacoustic principles is advantageous, because it at least avoids or circumvents one or more problems of existing approaches. For instance, the use of electroacoustics means that there is no need to have electrical contact with the programmable system of the munition, which means there is good galvanic isolation, which could improve safety.

This also means that there is no need to provide a conductive path between the communicating entity and the programmable system within the munition, which could be difficult when there are multiple physical barriers in place between the entity and the system. Also, the use of electroacoustics means an acoustic signal can be sent in a fluidic, for example water, environment and communication with the munition and its associated system is still readily practical and possible. This may not be the case with other approaches, for example, using electromagnetic radiation, inductive coupling, electrical contacts, and so on. Also, electroacoustic principles may be easier to implement within the munition than the provision of an electromagnetic wave receiver and processor. Again more generally, then, the use of electroacoustic principles may make it easier to generally communicate to a munition comprising a programmable system. These may also have advantages in terms of communicating a signal or data from an external surface of the munition or associated carrier or housing, to within the munition to the system itself, since the acoustic signal may more readily pass through physical objects and barriers in a detectable and usable manner than in comparison with, for example, electrical, optical or other approaches.

FIG. 15 shows how the inventive principles may be applied to the submunition 134 described previously. The fuze 158 described previously is shown as being part of a fuze system 200. The fuze system 200 is shown as comprising an electroacoustic transducer 202 that is arranged to receive an acoustic signal 204 (e.g. from external to the submunition 134). The acoustic signal 204 will comprise data of some kind, for use in programming the fuze system 200 in some way. The electroacoustic transducer 202 is therefore arranged to receive that signal 204 that comprises data, and convert that signal 204 into an electrical signal that comprises data. The system 200 also comprises a processor 206. The processor is arranged to receive and process the electrical signal provided by the transducer 202, and to use the data in that signal in programming of the fuze system 200. This can be undertaken in a number of different ways, as might be expected. For instance, in a simplistic manor, the signal may comprise data that is a triggering data signal for use in triggering the fuze 158 to trigger the explosive charge 156. In a more sophisticated example, the programming might involve providing the fuze system 200 with one or more environmental conditions required for triggering of the fuze 158 to take place. That is, for example, a timed arming or triggering, a depth to triggering or arming, coordinates for triggering or arming, and so on.

Depending on required sensitivities and particular applications, and even materials forming the submunition, the transducer 202 may be located within the submunition 134, and for example be attached to or in contact with a housing 208 of the submunition 134. Generally, it is envisaged that the provision of one or more transducers may be advantageous, for communicating across one or more physical barriers of the munition 134. Depending on the barrier or barriers in question, it may be required to locate a transducer either side of that barrier to provide effective communication through that barrier either via acoustic or electrical means or similar. However, and again depending on the nature of the barrier, acoustic signals might be incident upon and cause vibration of the barrier itself, and a transducer located on only one side of that barrier might be sensitive enough to receive and process that vibration and therefore the signal that was incident on that barrier.

Locating the transducer within the submunition may also have the advantage of not needing to in some way penetrate or otherwise compromise an external housing of the submunition, for example to provide a path for signals by way of cabling or windows, from external to the submunition, to internal to the submunition. This is important, because such comprising would likely have negative consequences for the integrity of the submunition, which will experience significant forces, and very different environments, during launch, expulsion, and water-entry.

FIG. 16 shows the submunition 134 located within its carrier 132. Although shown in a simplistic manner, it can be seen that a number of transducers 202 can be used relatively easily, to communicate across multiple barriers, for example the carrier 132 and munition housing 208, and therefore across solid objects, or even gaps 220.

An advantage of using an acoustic approach to programming of the programmable system is that the acoustic approach involves physical vibrations of some kind. It is possible for these physical vibrations to be used to actually power one or more parts of the programmable system. This can be undertaken using one or more dedicated transducers that form part of the system, or this can be undertaken using the same transducers that are used for the programming of the system with appropriate data. Of course, transmitting power to the munition is advantageous, as this might mean that the munition itself does not require a power source, or a power source dedicated to the fuze system. This might also provide an element of safety, in that the fuze system is not able to trigger the explosive charge unless it is powered and receives the appropriate data.

It is also important to realise that the use of acoustic signals, while in some ways perhaps simpler than an electromagnetic radiation approach, does not mean that the functionality is simplified. For example, the use of acoustic signals with associated data can still be used to provide some form of address or addressing for the system, for example in terms of addressing a particular part of the munition, or for addressing a munition among multiple munitions contained in a single carrier. For instance, addressing may be used to separately programme different parts of a fuze system or the programmable system in general, or to separately programme different submunitions contained within a single carrier or similar.

FIG. 17 schematically depicts general methodology associated with aspects of the system features already shown in and described in reference to FIGS. 15 and 16. FIG. 17 shows the methodology comprises a programming method for a munition. The method involves receiving an acoustic signal comprising data at the munition, and converting that signal into an electrical signal comprising data 232. The electrical signal comprising that data is then used in the programming of the munition 234.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A programmable system for a munition, the system comprising:

an electroacoustic transducer on the munition and arranged to receive an acoustic signal comprising data after the munition has been launched and has entered a body of water, and to convert the acoustic signal into an electrical signal representative of the acoustic signal and the data; and a processor on the munition configured to receive and process the electrical signal to obtain the data, and use the data to program a fuze of the munition with criteria, wherein the criteria provides one or more conditions which, upon being met, cause the fuse to be triggered with a triggering signal separate from the programming of the criteria.

2. The programmable system of claim 1, further comprising the fuze.

3. The programmable system of claim 1, wherein the processor is configured to facilitate programming of arming of the fuze or targeting functions.

4. The programmable system of claim 1, wherein the electroacoustic transducer is included in a plurality of electroacoustic transducers, for communicating across one or more physical barriers in the munition.

5. The programmable system of claim 4, wherein the one or more physical barriers comprise a housing of the munition, and/or a carrier for the munition.

6. The programmable system of claim 4, wherein the plurality of electroacoustic transducers include first and second electroacoustic transducers that are located on either side of a physical barrier included in the one or more physical barriers.

7. The programmable system of claim 4, wherein at least the processor, and at least one of the plurality of electroacoustic transducers, is located inside the munition, or inside a carrier for the munition.

8. The programmable system of claim 1, wherein the electroacoustic transducer is a first electroacoustic transducer, the acoustic signal is a first acoustic signal, and the electrical signal is a first electrical signal, and wherein the system comprises a second electroacoustic transducer, arranged to receive a second acoustic signal, and convert that second acoustic signal into a second electrical signal, the second electrical signal being used to power a part of the system.

9. The programmable system of claim 8, wherein the second electrical signal is arranged to power the processor or a component connected to the processor.

10. The programmable system of claim 1, wherein the data comprises an address, for addressing a part of the munition.

11. A munition comprising the programmable system of claim 1.

12. The munition of claim 11, wherein the munition is a submunition.

13. A munition assembly, the assembly comprising:

a carrier comprising a cavity; and a submunition in the cavity of the carrier, the submunition arranged to be controllably expelled from the carrier and including a submunition explosive charge, a submunition fuze, wherein the fuze of the munition of claim 1 is the submunition fuze, and the programmable system of claim 1;

wherein the munition assembly is adapted to be launched;

wherein the submunition is arranged to be controllably expelled from the carrier; and wherein the submunition fuze is adapted to trigger the submunition explosive charge.

14. The munition assembly of claim 13, wherein the assembly is adapted to be launched, into the air, from a gun barrel, and the submunition fuze is adapted to trigger the submunition explosive charge under water.

15. A programming method for a fuze of a munition, the method comprising:

receiving an acoustic signal comprising data at the munition after the munition has been launched and has entered a body of water, and converting the acoustic signal into an electrical signal representative of the acoustic signal and the data;

receiving and processing the electrical signal on the munition to obtain the data; and using the data to program the fuze within the munition with criteria, wherein the criteria provides one or more conditions which, upon being met, cause the fuse to be triggered with a triggering signal separate from the programming of the criteria, wherein the criteria is based on one or more environmental conditions of the body of water around the munition.

16. The fuze programming method of claim 15, wherein the electrical signal is used to power the processor.

17. The munition assembly of claim 13, wherein the submunition is adapted to, subsequent to the assembly being launched, be controllably expelled from the carrier and enter a body of water.

18. A programmable fuze system for a munition, the system comprising:

a first electroacoustic transducer on the munition and arranged to receive a first acoustic signal comprising data after the munition has been launched and has entered a body of water, and to convert the first acoustic signal into a first electrical signal representative of the first acoustic signal and the data;

a processor on the munition configured to receive and process the first electrical signal to obtain the data, and use the data to program a fuze of the munition with criteria, wherein the criteria provides one or more conditions which, upon being met, cause the fuse to be triggered with a triggering signal separate from the programming of the criteria, and wherein the criteria is based on one or more environmental conditions of the body of water around the munition; and a second electroacoustic transducer, arranged to receive a second acoustic signal, and convert the second acoustic signal into a second electrical signal representative of the second acoustic signal, the second electrical signal being used to power a part of the programmable fuze system.

19. The programmable system of claim 18, wherein the munition includes multiple submunitions contained in a single carrier, and wherein the data comprises an address for addressing one of the submunitions, and wherein the second electrical signal is arranged to power the processor or a component connected to the processor.

20. The programmable system of claim 1, wherein the criteria is based on one or more environmental conditions of the body of water around the munition, and wherein the one or more environmental conditions include: water salinity of the body of water around the munition, water temperature of the body of water around the munition, water pressure of the body of water around the munition, speed-of-sound in the body of water around the munition, presence of a magnetic or magnetizable structure in the body of water around the munition, presence of a pressure or sound wave in the body of water around the munition, moisture of the body of water around the munition, or depth of the body of water around the munition.

* * * * *